US009865206B2

(12) United States Patent
Miyazawa et al.

(10) Patent No.: US 9,865,206 B2
(45) Date of Patent: Jan. 9, 2018

(54) LIQUID CRYSTAL DISPLAY DEVICE INCLUDING DISPLAY CONTROL CIRCUITRY CONFIGURED TO STORE A POLARITY BIAS VALUE

(71) Applicant: Sharp Kabushiki Kaisha, Osaka-shi, Osaka (JP)

(72) Inventors: Jin Miyazawa, Osaka (JP); Kouji Kumada, Osaka (JP); Norio Ohmura, Osaka (JP); Noriyuki Tanaka, Osaka (JP); Tatsuhiko Suyama, Osaka (JP); Kentaroh Uemura, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 166 days.

(21) Appl. No.: 14/770,886

(22) PCT Filed: Feb. 12, 2014

(86) PCT No.: PCT/JP2014/053129
§ 371 (c)(1),
(2) Date: Aug. 27, 2015

(87) PCT Pub. No.: WO2014/136537
PCT Pub. Date: Sep. 12, 2014

(65) Prior Publication Data

US 2016/0012789 A1 Jan. 14, 2016

(30) Foreign Application Priority Data

Mar. 8, 2013 (JP) ..... 2013-046430

(51) Int. Cl.
*G09G 3/36* (2006.01)

(52) U.S. Cl.
CPC ..... *G09G 3/3614* (2013.01); *G09G 3/3648* (2013.01); *G09G 2310/08* (2013.01);
(Continued)

(58) Field of Classification Search
None
See application file for complete search history.

(56) References Cited

U.S. PATENT DOCUMENTS

2002/0180673 A1 12/2002 Tsuda et al.
2006/0267889 A1* 11/2006 Kimura ..... G09G 3/2022 345/84

(Continued)

FOREIGN PATENT DOCUMENTS

JP 2001-312253 A 11/2001
JP 2011-085680 A 4/2011
WO 2005/081054 A1 9/2005

OTHER PUBLICATIONS

Official Communication issued in International Patent Application No. PCT/JP2014/053129, dated Apr. 8, 2014.

*Primary Examiner* — Chad Dicke
(74) *Attorney, Agent, or Firm* — Keating & Bennett, LLP

(57) ABSTRACT

Provided are a liquid crystal display device and a driving method therefor that do not cause problems such as occurrence of flicker even when performing pause driving. When an off signal Soff instructing to turn off power is inputted, a polarity bias value W at the power-off is stored in a balance storage circuit. When the power is turned on again, the polarity bias value W is read from the balance storage circuit and provided to a balance control circuit. The balance control circuit starts insertion of a pause frame period to cancel out the polarity bias value W. By this, decrementing the polarity bias value W by "1" every insertion of a pause frame period is repeated. Then, at a point of time when the polarity bias value W becomes "0", insertion of a pause frame period is ceased and normal pause driving is performed.

4 Claims, 9 Drawing Sheets

(52) U.S. Cl.
CPC ..... *G09G 2320/0247* (2013.01); *G09G 2330/026* (2013.01); *G09G 2330/027* (2013.01)

(56) References Cited

U.S. PATENT DOCUMENTS

2006/0274011 A1* 12/2006 Igarashi ..... G09G 3/3648 345/94
2011/0157216 A1* 6/2011 Yamazaki ..... G02F 1/133553 345/596

* cited by examiner (A)

(B)

(C)

(A)

(B)

LIQUID CRYSTAL DISPLAY DEVICE INCLUDING DISPLAY CONTROL CIRCUITRY CONFIGURED TO STORE A POLARITY BIAS VALUE

TECHNICAL FIELD

The present invention relates to a liquid crystal display device and a method for driving the liquid crystal display device.

BACKGROUND ART

A plurality of pixel formation portions are formed in a matrix form in a display unit of an active matrix-type liquid crystal display device. Each pixel formation portion is provided with a thin film transistor (TFT) that operates as a switching element; and a pixel capacitance connected to a data signal line through the TFT. By turning on/off the TFT, a data signal for displaying an image is written as a data voltage to the pixel capacitance in the pixel formation portion. The data voltage is applied to a liquid crystal layer in the pixel formation portion to change the orientation direction of liquid crystal molecules, according to the voltage value of the data signal. In this manner, the liquid crystal display device controls the light transmittance of the liquid crystal layer in each pixel formation portion and thereby displays an image on the display unit.

When such a liquid crystal display device is mounted on a portable electronic device, etc., a reduction in power consumption thereof is required. In view of this, Japanese Patent Application Laid-Open No. 2001-312253 proposes a display device driving method in which immediately after a refresh period during which a display image is refreshed by scanning the scanning signal lines of a liquid crystal display device, a pause period (non-refresh period) during which the refresh is paused by bringing all of the scanning signal lines into a non-scanning state is provided. During the pause period, for example, control signals, etc., are not allowed to be provided to a gate driver and/or a source driver. By this, the operation of the gate driver and/or the source driver is paused, and accordingly, power consumption is reduced. Such driving where a pause period is provided immediately after a refresh period is called "pause driving". Note that the pause driving is also called "low-frequency driving" or "intermittent driving" and is suitable for still image display.

PRIOR ART DOCUMENTS

Patent Documents

[Patent Document 1] Japanese Patent Application Laid-Open No. 2001-312253

[Patent Document 2] Japanese Patent Application Laid-Open No. 2011-85680

SUMMARY OF THE INVENTION

Problems to be Solved by the Invention

In the liquid crystal display device, if the power is turned off when an image is displayed on the display unit, the TFTs in the pixel formation portions also go into an off state. Data voltages held in the pixel capacitances in the pixel formation portions at this time are held thereafter, too, with the voltage values thereof maintained. That is, accumulated charges corresponding to the data voltages remain in the pixel capacitances even after the power-off. Hence, when the TFT has a relatively large off-leakage current (current flowing through the TFT when in an off state), like when the channel layer of the TFT is made of amorphous silicon, etc., the data voltages held in the pixel capacitances are discharged to data signal lines through the TFTs in a short time after the power is turned off. However, when TFTs with a small off-leakage current like, for example, TFTs that use an oxide semiconductor such as an indium-gallium-zinc-oxide as channel layers are used as the switching elements in the pixel formation portions, direct-current voltages are continuously applied to the liquid crystal layer even after the power is turned off. Due to this, when the power is turned on again, problems such as the occurrence of an afterimage caused by burn-in of liquid crystal and the occurrence of flicker due to a deviation of an optimum common voltage (hereinafter, referred to as the "problems such as the occurrence of flicker") occur.

In addition, Japanese Patent Application Laid-Open No. 2011-85680 discloses performance of an off-sequence for discharging voltages held in pixel capacitances (accumulated charges in the pixel capacitances) by controlling voltages applied to the gate terminals, source terminals, and common electrode of TFTs when the power to a liquid crystal display device is turned off.

However, the inventors of the present application have found that, even when a liquid crystal display device that performs pause driving adopts an off-sequence configuration for discharging so as to solve the problems such as the occurrence of flicker that occurs due to accumulated charges remaining in the pixel capacitances even after power-off, the problems such as the occurrence of flicker may not be able to be solved in some cases.

An object of the present invention is therefore to provide a liquid crystal display device and a method for driving the liquid crystal display device that do not cause the problems such as the occurrence of flicker even when performing pause driving.

Means for Solving the Problems

A first aspect of the present invention is directed to a liquid crystal display device that displays an image represented by input image data on a display unit by applying voltages according to the input image data to a liquid crystal layer, the device comprising:

a driving unit configured to apply the voltages according to the input image data to the liquid crystal layer; and a display control unit configured to store a polarity bias value when an off signal instructing to turn off power to the liquid crystal display device is inputted, and drive, when an on signal instructing to turn on the power is inputted thereafter, the driving unit such that the polarity bias value is cancelled out before the image is displayed on the display unit, the polarity bias value indicating a degree of polarity bias of the voltages applied to the liquid crystal layer up to a point of time when the off signal is inputted.

According to a second aspect of the present invention, in the first aspect of the present invention, the display unit includes a plurality of pixel formation portions configured to hold voltages to be applied to the liquid crystal layer as data voltages, and the display control unit includes:

a balance storage unit configured to be able to store the polarity bias value;

a polarity bias calculating unit configured to calculate the polarity bias value and store the polarity bias value in the balance storage unit when the off signal is inputted; and a balance control unit configured to read the polarity bias value stored in the balance storage unit when the on signal is inputted, and control the driving unit such that the polarity bias value is cancelled out.

According to a third aspect of the present invention, in the second aspect of the present invention, wherein the polarity bias calculating unit includes a first polarity counter and a second polarity counter configured to count a number of pause periods during which writing of the data voltages is paused, and is configured to add a number of pause frame periods with a first polarity provided after the input of the on signal to a number of pause frame periods held in the first polarity counter, add a number of pause frame periods with a second polarity different than the first polarity to a number of pause frame periods held in the second polarity counter, and calculate, when the off signal is inputted, a difference between the number of pause frame periods with the first polarity held in the first polarity counter and the number of pause frame periods with the second polarity held in the second polarity counter, to use the difference as the polarity bias value.

According to a fourth aspect of the present invention, in the second aspect of the present invention, wherein the polarity bias calculating unit includes a first timer and a second timer configured to count an amount of time of pause periods during which writing of the data voltages is paused, and is configured to add an amount of time of pause frame periods with a first polarity provided after the input of the on signal to an amount of time held in the first timer, add an amount of time of pause frame periods with a second polarity different than the first polarity to an amount of time held in the second timer, and calculate, when the off signal is inputted, a difference between the amount of time of pause frame periods with the first polarity held in the first timer and the amount of time of pause frame periods with the second polarity held in the second timer, to use the difference as the polarity bias value.

According to a fifth aspect of the present invention, in the second aspect of the present invention, wherein the polarity bias calculating unit includes a polarity bias counter configured to count a number of pause periods during which writing of the data voltages is paused, and is configured to add, when a polarity of a pause frame period provided after the input of the on signal is a first polarity, a number of frame periods with the first polarity to a number of pause periods held in the polarity bias counter, subtract, when the polarity of the pause frame period is a second polarity different than the first polarity, a number of frame periods with the second polarity from the number of pause periods held in the polarity bias counter, and use the number of pause frame periods held in the polarity bias counter as the polarity bias value when the off signal is inputted.

According to a sixth aspect of the present invention, in the second aspect of the present invention, the display control unit further includes a REF/NREF determining unit configured to determine, for each frame period, whether the frame period is a refresh period during which data voltages are written to the plurality of pixel formation portions or a pause period during which writing of the data voltages to the plurality of pixel formation portions is paused, and the balance control unit is configured to control the driving unit when the on signal is inputted again after an off signal is inputted, such that a pause period with a polarity different than that of the polarity bias value obtained at a point of time when the off signal is inputted is inserted.

According to a seventh aspect of the present invention, in the sixth aspect of the present invention, wherein the REF/NREF determining unit is configured to compare image data for a preceding frame period with image data for a subsequent frame period to the preceding frame period, to detect whether an image is changed, and determine whether the subsequent frame period is a refresh period or a pause period by whether the image is changed.

According to an eighth aspect of the present invention, in the sixth aspect of the present invention, wherein the REF/NREF determining unit is configured to compare a result of a predetermined computation process using image data for a preceding frame period with a result of the computation process using image data for a subsequent frame period to the preceding frame period, to detect whether an image is changed, and determine whether the subsequent frame period is a refresh period or a pause period by whether the image is changed.

According to an ninth aspect of the present invention, in the sixth aspect of the present invention, wherein the balance control unit is configured to insert a refresh period after eliminating the degree of polarity bias by inserting the pause period, to reverse polarities of voltages to be applied to the liquid crystal layer, and further control the driving unit such that a refresh period during which the data voltages are written to the plurality of pixel formation portions and a pause period during which the writing of the data voltages to the plurality of pixel formation portions is paused appear alternately.

According to a tenth aspect of the present invention, in the sixth aspect of the present invention, the display control unit further includes a REF odd/even determination circuit configured to generate an odd/even signal indicating a result of a determination as to whether a total number of refresh frames determined by the REF/NREF determining unit is an odd number or an even number, and output the odd/even signal to the polarity bias calculation portion, and the polarity bias calculating portion includes a first polarity counter and a second polarity counter configured to count a number of pause periods during which writing of the data voltages is paused, and is configured to add a number of pause periods following an odd-numbered refresh frame to a number of pause periods held in the first polarity counter when it is determined based on the odd/even signal that the total number of refresh frames determined is an odd number, and add, when the number of refresh frames is an even number, a number of pause periods following an even-numbered refresh frame to a number of pause periods held in the second polarity counter, and calculate, when the off signal is inputted, a difference between the number of pause periods held in the first polarity counter and the number of pause periods held in the second polarity counter, to use the difference as the polarity bias value.

According to an eleventh aspect of the present invention, in the sixth aspect of the present invention, the display control unit further includes a REF odd/even determination circuit configured to generate an odd/even signal indicating a result of a determination as to whether a total number of refresh frames determined by the REF/

NREF determining unit is an odd number or an even number, and output the odd/even signal to the polarity bias calculating portion, and the polarity bias calculating portion includes a first timer and a second timer configured to count an amount of time of pause periods during which writing of the data voltages is paused, and is configured to add an amount of time of pause periods following an odd-numbered refresh frame to an amount of time of pause periods held in the first timer when it is determined based on the odd/even signal that the total number of refresh frames determined is an odd number, and add, when the number of refresh frames is an even number, an amount of time of pause periods following an even-numbered refresh frame to an amount of time of pause periods held in the second timer, and calculate, when the off signal is inputted, a difference between the amount of time of pause periods held in the first timer and the amount of time of pause periods held in the second timer, to use the difference as the polarity bias value.

According to a twelfth aspect of the present invention, in the sixth aspect of the present invention, the display control unit further includes a REF odd/even determination circuit configured to generate an odd/even signal indicating a result of a determination as to whether a total number of refresh frames determined by the REF/NREF determining unit is an odd number or an even number, and output the odd/even signal to the polarity bias calculating portion, and the polarity bias calculating portion includes a polarity bias counter configured to count a number of pause periods during which writing of the data voltages is paused, and is configured to add a number of pause periods following an odd-numbered refresh frame to a number of pause periods held in the polarity bias counter when it is determined based on the odd/even signal that the total number of refresh frames determined is an odd number, and subtract, when the number of refresh frames is an even number, a number of pause periods following an even-numbered refresh frame from the number of pause periods held in the polarity bias counter, and calculate, when the off signal is inputted, a number of pause periods held in the polarity bias counter to use the number of pause periods as the polarity bias value.

According to a thirteenth aspect of the present invention, in the second aspect of the present invention, further comprising data signal lines and scanning signal lines connected to the pixel formation portions and the driving unit, wherein each of the pixel formation portion includes:

a pixel capacitance configured to hold a corresponding one of the data voltages; and a switching element having a control terminal connected to a corresponding one of the scanning signal lines, and having a first conduction terminal connected to a corresponding one of the data signal lines, and having a second conduction terminal connected to the pixel capacitance, and the switching element includes a thin film transistor having a channel layer formed of an oxide semiconductor.

According to a fourteenth aspect of the present invention, in the thirteenth aspect of the present invention, wherein the oxide semiconductor has indium, gallium, zinc, and oxygen as main components.

A fifteenth aspect of the present invention is directed to a method for driving a liquid crystal display device that displays an image represented by input image data on a display unit by applying voltages according to the input image data to a liquid crystal layer in the display unit, the method comprising the steps of:

applying the voltages according to the input image data to the liquid crystal layer;

storing a polarity bias value in a balance storage unit when an off signal instructing to turn off power to the liquid crystal display device is inputted, the polarity bias value indicating a polarity bias of the voltages applied to the liquid crystal layer;

turning off the power to the liquid crystal display device;

reading the polarity bias value from the balance storage unit when an on signal instructing to turn on the power is inputted after the power to the liquid crystal display device is turned off; and controlling the application of the voltages to the liquid crystal layer such that the polarity bias value is cancelled out.

Effects of the Invention

According to the first aspect of the present invention, when an off signal instructing to turn off the power is inputted, a polarity bias value is stored that indicates the degree of polarity bias of voltages applied to the liquid crystal layer up to a point of time when the off signal is inputted. When the power to the liquid crystal display device is turned on thereafter, the polarity bias value is read and the driving unit is controlled such that the polarity bias value is cancelled out. By this, the polarity bias of the voltages applied to the liquid crystal layer is cancelled out, eliminating or suppressing charge accumulation caused by the uneven distribution of impurity ions in the liquid crystal layer. As a result, the problems such as the occurrence of flicker that occurs when the operation of the liquid crystal display device starts can be suppressed.

According to the second aspect of the present invention, when an off signal is inputted, a polarity bias value calculated by the polarity bias calculating unit is stored in the balance storage unit. When the power to the liquid crystal display device is turned on again, the polarity bias value stored in the balance storage unit is read, and the driving unit is controlled such that the polarity bias value is cancelled out. By this, the polarity bias value at a point of time when the off signal is inputted can be cancelled out in a short time after the power is turned on.

According to the third aspect of the present invention, the first polarity counter counts the number of pause frame periods with the first polarity appearing after an on signal is inputted, and the second polarity counter counts the number of pause frame periods with the second polarity. When an off signal is inputted, a difference between the number of pause frame periods with the first polarity held in the first polarity counter and the number of pause frame periods with the second polarity held in the second polarity counter is determined and used as a polarity bias value, and the polarity bias value is stored in the balance storage circuit. By this, a polarity bias value can be easily and promptly determined when an off signal is inputted.

According to the fourth aspect of the present invention, the first timer counts an amount of time of pause frame periods with the first polarity appearing after an on signal is inputted, and the second timer counts an amount of time of pause frame periods with the second polarity. When an off signal is inputted, a difference between the amount of time of pause frame periods with the first polarity held in the first timer and the amount of time of pause frame periods with the second polarity held in the second timer is determined and used as a polarity bias value, and the polarity bias value is stored in the balance storage circuit. By this, a polarity bias value can be easily and promptly determined when an off signal is inputted.

According to the fifth aspect of the present invention, when an on signal is inputted again after an off signal is inputted, the balance control unit inserts a pause period with a different polarity than that of a polarity bias value. By this, a polarity bias value at a point of time when the off signal is inputted is cancelled out. Thus, the problems such as the occurrence of flicker that occurs when the liquid crystal display device is allowed to operate by turning on the power thereafter can be suppressed.

According to the sixth aspect of the present invention, when the polarity of a pause frame period provided after the input of an on signal is the first polarity, the number of frame periods with the first polarity is added to the number of pause periods held in the polarity bias counter. In addition, when the polarity of the pause frame period is the second polarity different than the first polarity, the number of frame periods with the second polarity is subtracted from the number of pause periods held in the polarity bias counter. When an off signal is inputted, the number of pause periods held in the polarity bias counter is used as a polarity bias value, and the polarity bias value is stored in the balance storage circuit. By this, a polarity bias value can be easily and promptly determined when an off signal is inputted.

According to the seventh aspect of the present invention, even a slight change in an image can be detected, and it can be determined based on a result of the detection whether a subsequent frame period is a refresh period or a pause period.

According to the eighth aspect of the present invention, without the device including a large-capacity memory, whether an image is changed is detected, and it can be determined based on a result of the detection whether a subsequent frame period is a refresh period or a pause period.

According to the ninth aspect of the present invention, the balance control circuit controls the driving unit to perform pause driving after canceling out a polarity bias value. By this, the problems such as the occurrence of flicker can be prevented from occurring upon pause driving.

According to the tenth aspect of the present invention, the REF odd/even determination circuit determines whether the number of refresh frames determined is an odd number or an even number that is counted from when the power is turned on. If the number is an odd number, the number of pause periods following an odd-numbered refresh frame is added to the number of pause periods held in the first polarity counter. If the number is an even number, the number of pause periods following an even-numbered refresh frame is added to the number of pause periods held in the second polarity counter. Then, when an off signal is inputted, a difference between the number of pause periods held in the first polarity counter and the number of pause periods held in the second polarity counter is determined and used as a polarity bias value. By this, a polarity bias value can be easily and promptly determined when an off signal is inputted.

According to the eleventh aspect of the present invention, the REF odd/even determination circuit determines whether the number of refresh frames determined is an odd number or an even number that is counted from when the power is turned on. If the number is an odd number, an amount of time of pause periods following an odd-numbered refresh frame is added to an amount of time held in the first timer. If the number is an even number, an amount of time of pause periods following an even-numbered refresh frame is added to an amount of time held in the second timer. Then, when an off signal is inputted, a difference between the amount of time held in the first timer and the amount of time held in the second timer is determined and used as a polarity bias value. By this, a polarity bias value can be easily and promptly determined when an off signal is inputted.

According to the twelfth aspect of the present invention, the REF odd/even determination circuit determines whether the number of refresh frames determined is an odd number or an even number that is counted from when the power is turned on. If the number is an odd number, the number of pause periods following an odd-numbered refresh frame is added to the number of pause periods held in the polarity bias counter. If the number is an even number, the number of pause periods following an even-numbered refresh frame is subtracted from the number of pause periods held in the polarity bias counter. Then, when an off signal is inputted, the number of pause periods held in the polarity bias counter is used as a polarity bias value. By this, a polarity bias value can be easily and promptly determined when an off signal is inputted.

According to the thirteenth aspect of the present invention, as a switching element in each pixel formation portion of an active matrix-type liquid crystal display device, a thin film transistor having a channel layer formed of an oxide semiconductor is used. By this, the off-leakage current of the thin film transistor is significantly reduced, and accordingly, a voltage written to a pixel capacitance in each pixel formation portion is held for a longer period of time.

According to the fourteenth aspect of the present invention, by using indium-gallium-zinc-oxide as an oxide semiconductor that forms the channel layer of the thin film transistor included in the pixel formation portion, the effect provided by the twelfth aspect of the present invention can be certainly obtained.

According to the fifteenth aspect of the present invention, the same effects as those provided by the first and second aspects of the present invention are provided, and thus, a description thereof is omitted.

BRIEF DESCRIPTION OF THE DRAWINGS

FIG. 5(A) is a timing chart showing a change in a polarity bias value during a period of t=0 to 1, FIG. 5(B) is a timing chart showing a change in the polarity bias value W during a period of t=1 to 2, FIG. 5(C) is a timing chart showing a change in the polarity bias value W during a period of t=2 to 3, and FIG. 5(D) is a timing chart showing a change in the polarity bias value W during a period of t=0 to 1 after the power is turned on again.

FIG. 6(A) is a timing chart showing changes in a polarity bias value during a period from when the power is turned on for the first time until the power is turned off, FIG. 6(B) is a timing chart showing changes in the polarity bias value during a period from when the power is turned on for the second time until the power is turned off, and FIG. 6(C) is a timing chart showing changes in the polarity bias value during a period from when the power is turned on for the third time until the power is turned off.

MODE FOR CARRYING OUT THE INVENTION

Although the following describes an embodiment of the present invention, mainly a liquid crystal display device that performs pause driving, the present invention is also applicable to a liquid crystal display device that does not perform pause driving. In addition, in the description of the liquid crystal display device that performs pause driving, one frame period for writing, as data voltages, the voltages of image signals representing an image to be displayed to pixel formation portions is referred to as a "refresh frame period", and one frame period during which the writing of data voltages is paused is referred to as a "pause frame period". Note that the "one frame period" is a period that requires for refresh (rewriting or writing of data voltages) for one screen. In addition, a plurality of pause frame periods may be collectively referred to as a "pause period", and the refresh frame period may be referred to as a refresh period. In the following description, the length of "one frame period" is 16.67 ms which is the length of one frame period for the case of a general display device with a refresh rate of 60 Hz, but the present invention is not limited thereto.

<0. Basic Study>

Before describing an embodiment of the present invention, a basic study conducted by the inventors of the present application to solve the above-described problems will be described.

Figure 1:
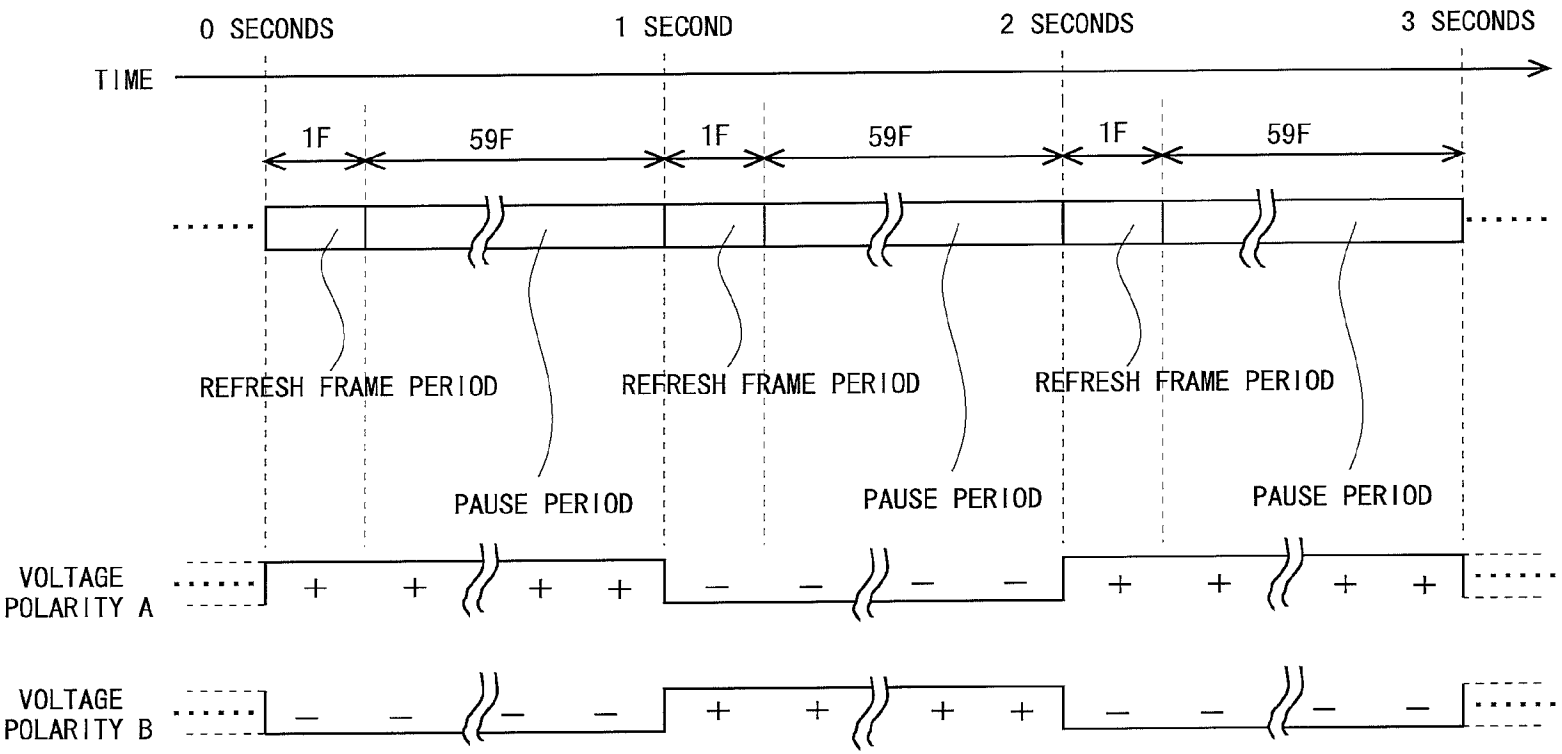
FIG. 1 is a timing chart for describing an example of pause driving of a liquid crystal display device.

FIG. 1 is a timing chart for describing an example of pause driving of a liquid crystal display device. In the example, during the first one frame period, writing of data voltages for one screen is performed, and during the subsequent 59 frame periods, the writing of data voltages is paused. That is, the liquid crystal display device is driven such that one refresh frame period and 59 pause frame periods appear alternately. In this case, the refresh rate is 1 Hz and the refresh cycle is 1 second. Note that in FIG. 1, 59 pause frame periods are collectively shown as a pause period.

In addition, in FIG. 1, the polarities of data voltages to be written to the pixel formation portions are reversed every refresh frame period. In FIG. 1, a voltage polarity A indicates the polarity of a data voltage written to one pixel formation portion (voltage held in the pixel capacitance in the pixel formation portion), and the voltage polarity B indicates the polarity of a data voltage written to another pixel formation portion during the same frame period, and differs from the voltage polarity A. As can be seen from the voltage polarities A and B shown in FIG. 1, the polarity of a data voltage held in the pixel capacitance in each pixel formation portion (voltage applied to the liquid crystal layer in the pixel formation portion) is reversed every second. This reversal cycle is very long compared to 16.67 ms which is the reversal cycle of a normal liquid crystal display device.

The liquid crystal display device displays an image by controlling the light transmittance of the liquid crystal layer by applying voltages to the liquid crystal layer. However, if the applied voltages include a direct-current component, then charge accumulation (charge bias) caused by impurity ions in the liquid crystal layer that are unevenly distributed in the liquid crystal layer occurs, causing the problems such as the occurrence of flicker. To prevent such problems from occurring, the liquid crystal display device performs alternating-current driving. Specifically, the liquid crystal display device is configured to reverse the polarities of voltages applied to the liquid crystal layer every predetermined period, like the voltage polarities A and B shown in FIG. 1, so that the time-integrated value of the voltage applied to the liquid crystal layer becomes substantially "0".

However, depending on the timing at which the power to the liquid crystal display device is turned off, the time-integrated value of the voltage applied to the liquid crystal layer does not become "0" and accordingly a charge bias may occur. For example, in a liquid crystal display device with a refresh rate of 1 Hz, if the power is turned off two seconds after the power is turned on, the time-integrated value of voltage applied to the liquid crystal layer becomes "0" and thus a charge bias does not occur. However, if the power is turned off three seconds after the power is turned on, the time-integrated value of the voltage applied to the liquid crystal layer does not become "0". In this case, the liquid crystal display device stops its operation with a charge bias occurring, and thus, the charge bias that has occurred during one second immediately before the power is turned off occurs in the liquid crystal layer.

Figure 2:
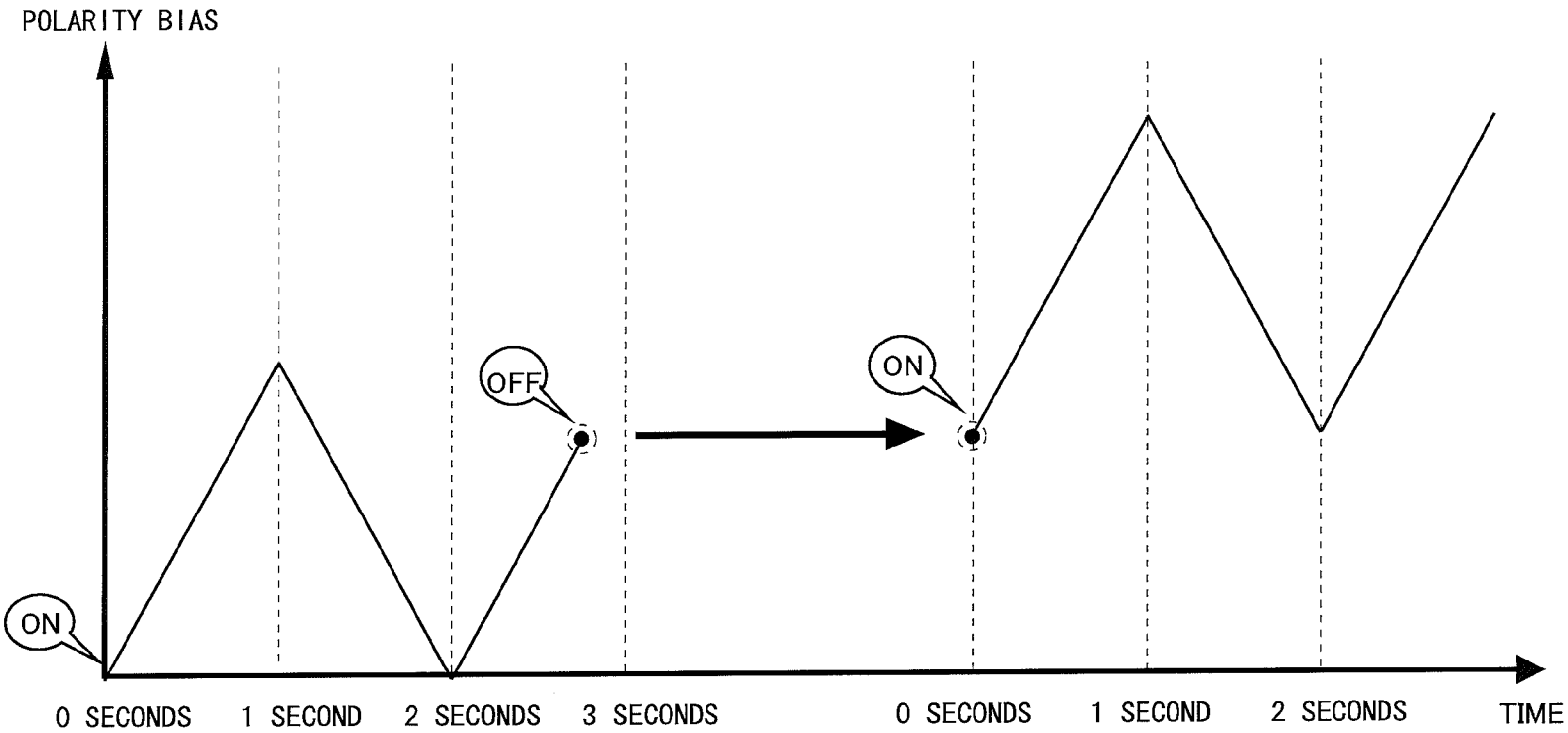
FIG. 2 is a timing chart showing a charge bias occurring when the power is turned on again in the liquid crystal display device where a charge bias has occurred.

FIG. 2 is a timing chart showing a charge bias occurring when the power is turned on again in the liquid crystal display device where a charge bias has occurred. As shown in FIG. 2, when the power to the liquid crystal display device is turned on again, the liquid crystal display device performs pause driving such that one refresh frame period and 59 pause frame periods appear alternately, with a charge bias occurring at the power-off maintained. Hence, the charge bias becomes larger, and accordingly, the problems such as the occurrence of flicker may become greater.

In addition, the inventors of the present application propose in Japanese Patent Application No. 2012-288969 which is filed earlier that in order to solve the problems such as the occurrence of flicker, when an off signal is inputted to the liquid crystal display device, a required number of pause frame periods are inserted to reduce the time-integrated value of an applied voltage to "0", and thereafter, an off-sequence for discharge is further performed.

Figure 3:
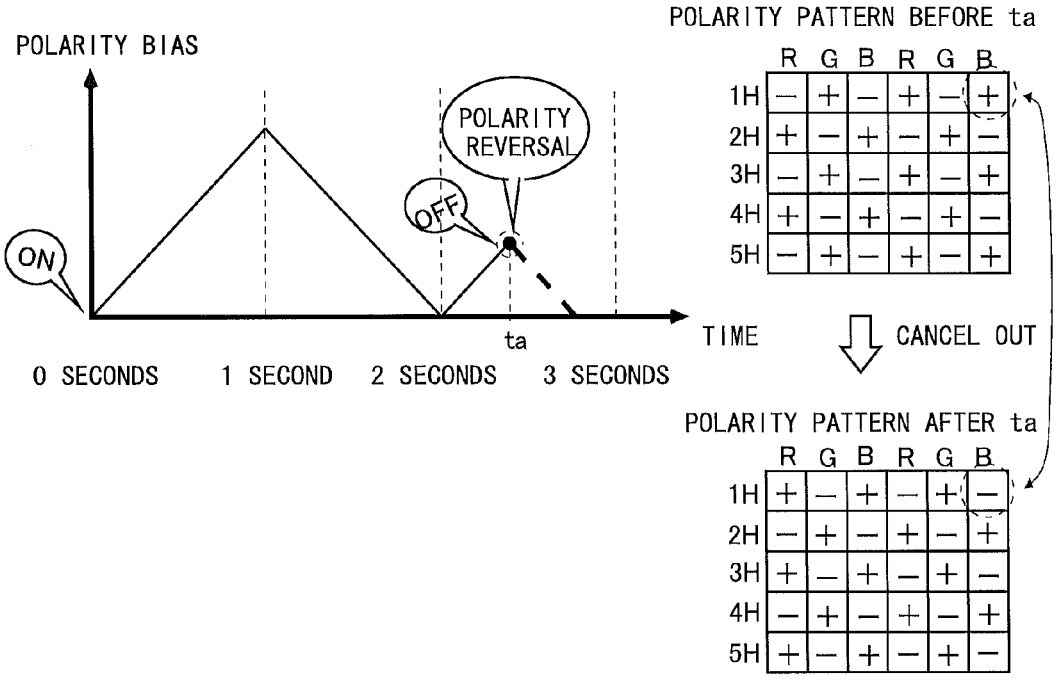
FIG. 3 is a timing chart for reducing the time-integrated value of a voltage applied to a liquid crystal layer to "0" by inserting a required number of pause frame periods when an off signal is inputted.

FIG. 3 is a timing chart for reducing the time-integrated value of a voltage applied to the liquid crystal layer to "0" by inserting a required number of pause frame periods when an off signal is inputted. As shown in FIG. 3, an off signal that instructs power-off is inputted from a host at point of time ta included in a period of t=2 to 3. At this point of time when the power-off is instructed (point of time of the power-off instruction) ta, a charge bias (polarity bias) is in an increasing direction, and thus, a refresh frame period is inserted at the point of time of the power-off instruction ta so as to reverse the polarity. By this, the polarity of a data voltage held in each pixel formation portion is reversed. Thereafter, insertion of a pause frame period is repeated. During the pause frame periods, the data voltage written to each pixel formation portion during the immediately preceding refresh frame period is held. By this, a polarity bias in each pixel formation portion at the point of time of the power-off instruction ta is cancelled out by a polarity bias that occurs during the pause frame periods inserted after the point of time of the power-off instruction ta. Accordingly, as indicated by a dashed line in FIG. 3, the polarity bias is decreased by "1" every time one pause frame period ends. At a point of time when the polarity bias becomes "0" in this manner, the polarity bias is eliminated and thus the insertion of a pause frame period is ceased. Note that polarity patterns described on the right side in FIG. 3 show that a voltage applied to the liquid crystal layer in each pixel formation portion before the point of time of the power-off instruction ta is cancelled out by a voltage applied during pause frame periods inserted after the point of time of the power-off instruction ta.

Then, an off-sequence for discharge starts at a point of time of the cessation. When the off-sequence is completed, the power to the liquid crystal display device is turned off. Since the charge bias has been eliminated when the power is turned off, when the power is turned on again, normal pause driving is performed where one refresh frame period and 59 pause frame periods are repeated alternately.

In this case, when the power is turned on again, the problems such as the occurrence of flicker caused by the charge bias occurring at the point of time of the power-off instruction ta do not occur. However, a predetermined standby time is required to turn off the power to the liquid crystal display device after the point of time of the power-off instruction ta. Note that although the above description is made of the case in which an off signal is inputted during an odd-numbered refresh period after the power is turned on and its subsequent pause periods, the same also applies to the case in which an off signal is inputted during an even-numbered refresh period and its subsequent pause periods.

An embodiment of the present invention which is made based on the above basic study to solve the problems such as the occurrence of flicker caused by a polarity bias will be described below.

1. First Embodiment

1.1 Overall Configuration and Summary of Operation

Figure 4:
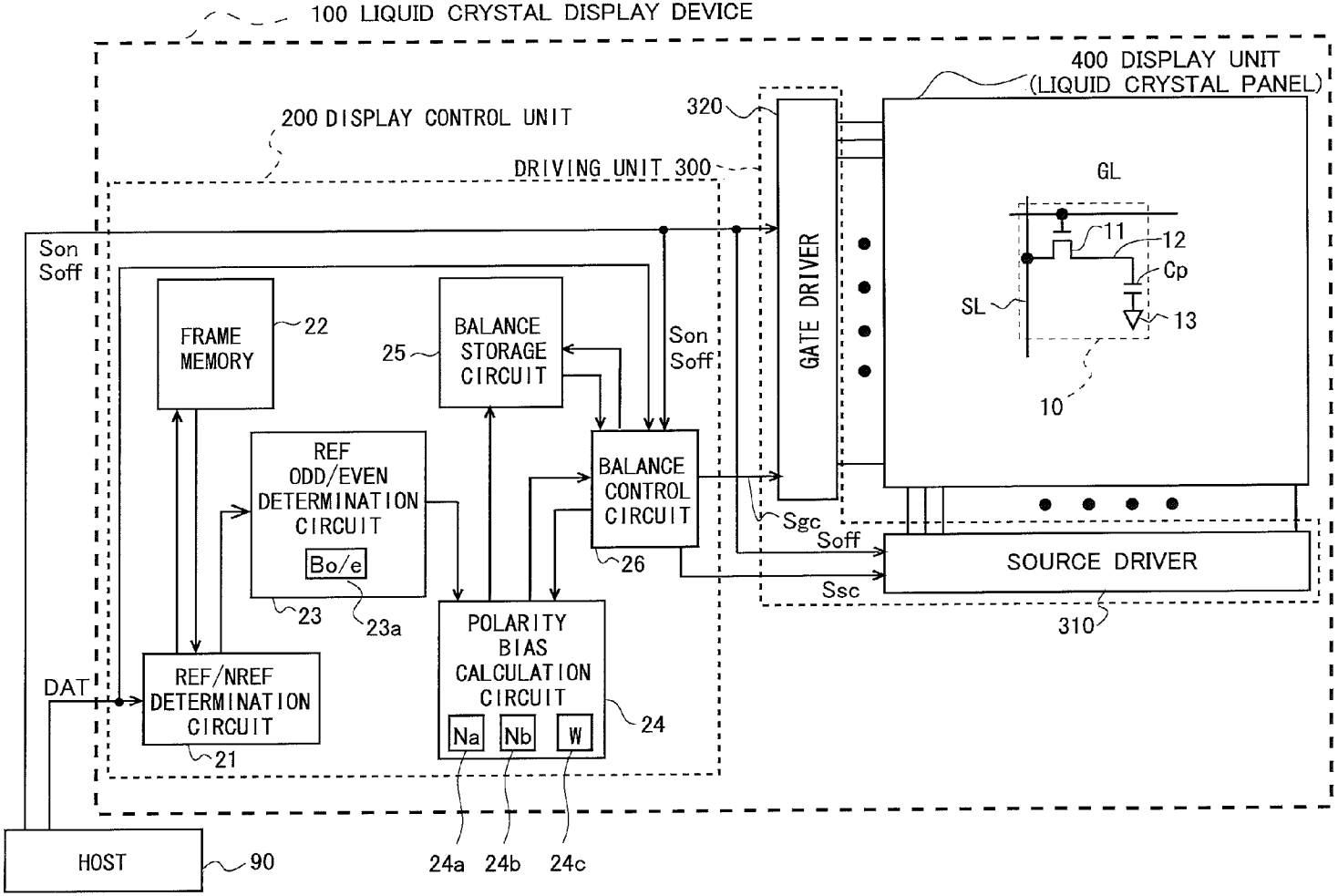
FIG. 4 is a block diagram showing a configuration of a liquid crystal display device according to an embodiment of the present invention.

FIG. 4 is a block diagram showing a configuration of a liquid crystal display device 100 according to an embodiment of the present invention. The liquid crystal display device 100 includes a display control unit 200, a driving unit 300, and a display unit 400. The driving unit 300 includes a source driver (also referred to as a "data signal line drive circuit") 310 and a gate driver (also referred to as a "scanning signal line drive circuit") 320. The display unit 400 forms a liquid crystal panel. The liquid crystal panel may be configured such that both or one of the source driver 310 and the gate driver 320 are (is) integrally formed with the display unit 400. A host 90 which is mainly composed of a CPU (Central Processing Unit) is provided external to the liquid crystal display device 100.

In the display unit 400 are formed a plurality of data signal lines (also referred to as "source bus lines") SL, a plurality of scanning signal lines (also referred to as "gate bus lines") GL, and a plurality of pixel formation portions 10 arranged in a matrix form at the respective intersections of the plurality of data signal lines SL and the plurality of scanning signal lines GL. For convenience sake, FIG. 4 shows one pixel formation portion 10, and one data signal line SL and one scanning signal line GL which are connected to the pixel formation portion 10. The pixel formation portion 10 includes a thin film transistor (TFT) 11 that functions as a switching element having a gate terminal connected to a corresponding scanning signal line GL and having a source terminal (also referred to as a "first conduction terminal") connected to a corresponding data signal line SL; a pixel electrode 12 connected to a drain terminal (also referred to as a "second conduction terminal") of the TFT 11; a common electrode 13 provided so as to be shared by the plurality of pixel formation portions 10; and a liquid crystal layer (not shown) that is sandwiched between the pixel electrode 12 and the common electrode 13 and that is provided so as to be shared by the plurality of pixel formation portions 10. A pixel capacitance Cp is composed of a liquid crystal capacitance which is composed of the pixel electrode 12 and the common electrode 13. Note that typically an auxiliary capacitance is provided in parallel to the liquid crystal capacitance so as to certainly hold a voltage in the pixel capacitance Cp, and thus, in practice, the pixel capacitance Cp is composed of the liquid crystal capacitance and the auxiliary capacitance.

In the present embodiment, as the TFT 11, for example, a TFT that uses an oxide semiconductor as a channel layer (hereinafter, referred to as an "oxide TFT") is used. More specifically, the channel layer of the TFT 11 is formed of In—Ga—Zn—O (indium-gallium-zinc-oxide) which has indium (In), gallium (Ga), zinc (Zn), and oxygen (O) as main components. In the TFT using In—Ga—Zn—O as the channel layer, off-leakage current is significantly reduced compared to a silicon-based TFT using amorphous silicon, etc., as a channel layer, and thus, a voltage written to the pixel capacitance Cp in each pixel formation portion 10 is held for a longer period of time. Note that the same advantageous effect can be obtained even when using, as an oxide semiconductor other than In—Ga—Zn—O, for example, an oxide semiconductor including at least one of indium, gallium, zinc, copper (Cu), silicon (Si), tin (Sn), aluminum (Al), calcium (Ca), germanium (Ge), and lead (Pb), for a channel layer.

The display control unit 200 is typically implemented as an IC (Integrated Circuit). The display control unit 200 receives from the host 90 data DAT including input image data representing an image to be displayed, and generates and outputs a source driver control signal Ssc, a gate driver control signal Sgc, a common voltage signal, and the like, according to the data DAT. The source driver control signal Ssc is provided to the source driver 310, the gate driver control signal Sgc is provided to the gate driver 320, and the common voltage signal which is not shown is provided to the common electrode 13 provided in the display unit 400. In addition, an off signal Soff that instructs to turn off the power to the liquid crystal display device 100 and an on signal Son that instructs to turn on the power are also inputted to the display control unit 200 from the host 90. The off signal Soff and the on signal Son are further provided to the source driver 310 and the gate driver 320.

The source driver 310 generates and outputs a data signal (data signal) to be provided to each data signal line SL, according to the source driver control signal Ssc. The source driver control signal Ssc includes, for example, a digital video signal representing an image to be displayed, a source start pulse signal, a source clock signal, a latch strobe signal, a polarity switching control signal, and the like. The source driver 310 allows a shift register, a sampling latch circuit, and the like, provided therein and not shown, to operate according to such a source driver control signal Ssc, and converts digital signals obtained based on the digital video signal into analog signals by a DA converter circuit which is not shown, and thereby generates data signals (data voltages).

The gate driver 320 repeats application of an active scanning signal to each scanning signal line GL in a predetermined cycle, according to the gate driver control signal Sgc. The gate driver control signal Sgc includes, for example, agate clock signal and a gate start pulse signal. The gate driver 320 allows a shift register, etc., provided therein and not shown, to operate according to the gate clock signal and the gate start pulse signal, and thereby generates scanning signals.

A backlight unit (not shown) is provided on the back side of the display unit 400. The backlight unit performs irradiation of backlight's light from the back of the display unit 400. The backlight unit may be controlled by the display control unit 200 or may be controlled by other methods. Note that when the liquid crystal panel is of a reflective type, a backlight unit does not need to be provided.

In the above-described manner, a data signal is applied to each data signal line SL, a scanning signal is applied to each scanning signal line GL, and the backlight unit is driven, by which an image represented by the input image data included in the data DAT which is transmitted from the host 90 is displayed on the display unit 400 of the liquid crystal panel.

1.2 Configuration of the Display Control Unit

As shown in FIG. 4, the display control unit 200 includes a REF/NREF determination circuit 21, a frame memory 22, a REF odd/even determination circuit 23, a polarity bias calculation circuit 24, a balance storage circuit 25, and a balance control circuit 26. Data DAT including input image data which is transmitted from the host 90 is provided to the REF/NREF determination circuit 21 and the balance control circuit 26, and an on signal Son and an off signal Soff that turn on/off the liquid crystal display device 100 are provided to the balance control circuit 26.

Based on the data DAT received from the host 90, the REF/NREF determination circuit 21 determines, for each frame period and every frame period, whether the frame period is a refresh frame period or a pause frame period, and generates a REF/NREF signal indicating a result of the determination and provides the REF/NREF signal to the REF odd/even determination circuit 23. In addition, the REF/NREF signal is also provided to the polarity bias calculation circuit 24 and the balance control circuit 26 through the REF odd/even determination circuit 23.

The frame memory 22 is formed of a DRAM (Dynamic Random Memory) which is a volatile memory, etc., and can store image data for one frame. Hence, the REF/NREF determination circuit 21 stores input image data for the preceding frame in advance in the frame memory 22, and determines whether an image represented by input image data included in data DAT which is received from the host 90 is changed from an image represented by the input image data which is stored in the frame memory 22. If it is determined that the image is changed, the frame period is determined to be a refresh frame period. If it is determined that the image is not changed, the frame period is determined to be a pause frame period.

In addition, even if a period where an image represented by input image data does not change or a period where new input image data is not received from the host 90 continues, the REF/NREF determination circuit 21 generates a REF/NREF signal so as to insert a refresh frame period every predetermined period. For example, when a pause period continues for a 59-frame period, a REF/NREF signal is generated so that the subsequent frame period becomes a refresh period, i.e., so that a refresh period can be inserted once every second.

The REF odd/even determination circuit 23 determines, based on the above-described REF/NREF signals, whether the number of refreshes performed up to the present time from a point of time when the power is turned on, i.e., the number of refresh frame periods included in this period, is an odd number or an even number, and generates an odd/even signal indicating a result of the determination and provides the odd/even signal to the polarity bias calculation circuit 24. To determine whether the number of refreshes is an odd number or an even number, an odd/even bit register 23*a* which is a 1-bit register is provided in the REF odd/even determination circuit 23. An odd/even bit value Bo/e which is the value of the odd/even bit register 23*a* is initialized to "0" at a point of time of power-on, and is changed to "1" at a point of time of the start of the first refresh frame period which appears immediately after the power-on. Thereafter, the odd/even bit value Bo/e is changed alternately between "1" and "0" every time a refresh frame period appears. Hence, when the number of refreshes performed up to the present time from a point of time when the power is turned on is an odd number, the odd/even bit value Bo/e is "1", and when the number of refreshes is an even number, the odd/even bit value Bo/e is "0". An odd/even signal composed of such an odd/even bit value Bo/e is provided to the polarity bias calculation circuit 24.

The polarity bias calculation circuit 24 includes two registers to store values indicating the degrees of polarity bias up to the present time from a point of time when the power is turned on. In the following, the two registers are referred to as a "first polarity counter 24*a*" and a "second polarity counter 24*b*", respectively, and a first count value indicating the degree of polarity bias which is stored in the first polarity counter 24*a* is represented by the symbol "Na", and a second count value indicating the degree of polarity bias which is stored in the second polarity counter 24*b* is represented by the symbol "Nb". In the present embodiment, the "polarity bias" refers to the difference between the total number of pause frame periods during which a positive data voltage is held in the same pixel formation portion and the total number of pause frame periods during which a negative data voltage is held in that same pixel formation portion. When the difference is "0", there is no polarity bias. Although in the following a polarity bias is represented in units of one frame period, the configuration is not limited thereto.

When the odd/even signal provided from the REF odd/even determination circuit 23 is "1", i.e., the number of refreshes performed up to the present time from a point of time when the power is turned on is an odd number, every time a REF/NREF signal indicating a pause frame period which is included in this refresh period is provided, the polarity bias calculation circuit 24 counts the number of the REF/NREF signals, and increments the first count value Na of the first polarity counter 24*a* by "1". In addition, when the odd/even signal is "0", i.e., the number of refreshes is an even number, every time a REF/NREF signal indicating a pause frame period that follows the immediately preceding refresh frame period is provided, the polarity bias calculation circuit 24 counts the number of the REF/NREF signals, and increments the second count value Nb of the second polarity counter 24*b* by "1".

Then, in order to determine a polarity bias, the polarity bias calculation circuit 24 subtracts the second count value Nb from the first count value Na and thereby determine a polarity bias value W, and stores the polarity bias value W in a polarity bias counter 24*c* and provides the polarity bias value W to the balance control circuit 26. From this fact, when there is a larger number of positive pause frame periods, the polarity bias value W is a positive value, and the larger the number the larger the polarity bias value W. On the other hand, when there is a larger number of negative pause frame periods, the polarity bias value W is a negative value, and the larger the number the smaller the polarity bias value W. In this manner, the polarity bias value W can be easily and promptly determined when an off signal is inputted. Note that the polarity bias value W may be determined by subtracting the first count value Na from the second count value Nb.

The balance control circuit 26 controls the source driver 310 and the gate driver 320 based on data DAT received from the host 90 and a REF/NREF signal provided from the REF/NREF determination circuit 21, until an off signal Soff instructing to turn off the power is inputted from the host 90 (until an off signal Soff is activated) after the power is turned on. By this, the source driver 310 and the gate driver 320 perform normal pause driving where one refresh frame period and 59 pause frame periods are repeated alternately, so that an image represented by input image data included in the data DAT can be displayed on the display unit 400.

In this driving, if it is determined based on a REF/NREF signal that the frame period is a refresh frame period, refresh where the polarities of data voltages held in the pixel formation portions are reversed and rewritten based on input image data is performed. If it is determined that the frame period is a pause frame period, the refresh is paused by bringing all of the scanning signal lines GL into a non-selected state.

In addition, when forced refresh based on new input image data which is received from the host 90 (hereinafter, this refresh is referred to as "forced refresh") is not performed during a pause period, refresh is performed every predetermined period (hereinafter, this refresh is referred to as "periodic refresh"). In this manner, driving such as that shown in FIG. 1 is performed.

When an off signal Soff is inputted to the balance control circuit 26 from the host 90, the balance control circuit 26 performs control such that the driving unit 300 including the source driver 310 and the gate driver 320 stops its operation. In addition, the balance control circuit 26 generates a stop signal indicating that the off signal Soff has been inputted, and provides the stop signal to the polarity bias calculation circuit 24.

When the stop signal is provided to the polarity bias calculation circuit 24 from the balance control circuit 26, the polarity bias calculation circuit 24 calculates a polarity bias value W which is determined based on the first count value Na of the first polarity counter 24*a* and the second count value Nb of the second polarity counter 24*b*, and stores the polarity bias value W in the balance storage circuit 25. The balance storage circuit 25 is formed of a nonvolatile memory such as a flash memory. Hence, even when the power to the entire system including the liquid crystal display device 100 is turned off, the balance storage circuit 25 can continuously store the polarity bias value W.

When the power is turned on again with the balance storage circuit 25 storing the polarity bias value W, data DAT and an on signal Son are provided to the balance control circuit 26 from the host 90. When the balance control circuit 26 receives the on signal Son, the balance control circuit 26 generates a read signal to read the polarity bias value W stored in the balance storage circuit 25, and provides the read signal to the balance storage circuit 25. When the balance storage circuit 25 receives the read signal, the balance storage circuit 25 provides the stored polarity bias value W to the balance control circuit 26.

The balance control circuit 26 controls the driving unit 300 including the source driver 310 and the gate driver 320 to repeat insertion of one frame of a pause frame period, so that the provided polarity bias value W is reduced by 1. During the pause frame period, a data voltage having a polarity represented by the polarity bias value W is cancelled out by a data voltage having a different polarity than the polarity. Hence, the balance control circuit 26 repeats decrementing the polarity bias value W by "1" every time one frame of a pause frame period is inserted.

When the polarity bias value W becomes "0" in this manner, the insertion of a pause frame period is ceased, and a refresh frame period with a reversed polarity is inserted to reverse the polarity of the voltage applied to the liquid crystal layer. Thereafter, the balance control circuit 26 controls the driving unit 300 to perform normal pause driving based on data DAT provided from the host 90, until an off signal Soff is inputted again.

1.3 First Operation Example

A first operation example of the present embodiment will be described. FIGS. 5(A) to 5(D) are timing charts showing the first operation example. In the first operation example, as shown in FIG. 1, once-a-second periodic refresh is performed. Every time refresh is performed, the polarity of a data voltage held in each pixel formation portion 10 is reversed.

Figure 5:
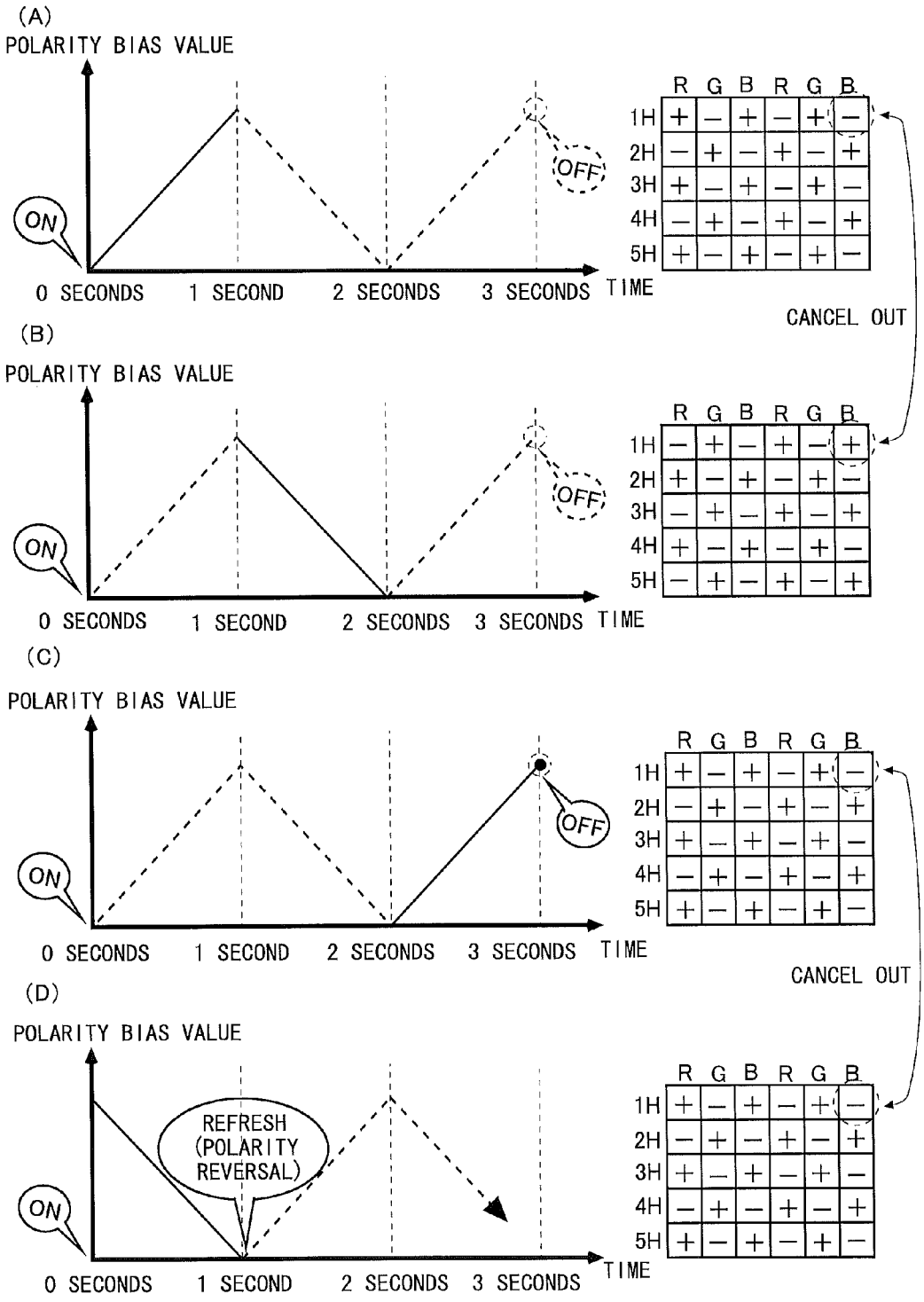
FIGS. 5(A) to 5(D) are timing charts showing a first operation example of the liquid crystal display device according to the embodiment of the present invention.

FIG. 5(A) shows a change in the polarity bias value W during a period from when the power is turned on until one second has elapsed, i.e., t=0 to 1, and a polarity pattern of the display unit 400 of the liquid crystal display device. The change in the polarity bias value W is indicated by a solid line in a graph on the left side in FIG. 5(A), and the polarity pattern is shown in a schematic diagram on the right side in FIG. 5(A). The same also applies to FIGS. 5(B) to 5(D) which will be described below. In addition, in the polarity patterns shown in FIGS. 5(A) to 5(D), for convenience of description, the number of pixels in a vertical direction is five and the number of pixels in a horizontal direction is six. In addition, although the polarity patterns are premised on a dot-reversal driving scheme, the present invention is not limited thereto.

In this operation example, when the power is turned on at point of time t=0, pause driving is performed such that the first one frame period is a refresh frame period and the subsequent 59 frame periods are all pause frame periods. During the pause frame periods, a data voltage written to each pixel formation portion during the immediately preceding refresh frame period is held at a substantially unchanged voltage value. As shown in FIG. 5(A), during a period of t=0 to 1, voltages having the same polarity are applied in any of the frame periods, and thus, the polarity bias W monotonously (linearly) increases.

FIG. 5(B) shows a change in the polarity bias value W during a period of t=1 to 2, and a polarity pattern of the display unit of the liquid crystal display device. During the first refresh frame period after point of time t=1 where one second has elapsed since the power is turned on, the polarity of the voltage applied to the liquid crystal layer (a data voltage held in each pixel formation portion 10) is reversed by writing of a data voltage. The subsequent 59 frame periods are all pause frame periods. During the pause frame periods, the data voltage written to each pixel formation portion 10 during the immediately preceding refresh period is held at a substantially unchanged voltage value. Hence, as shown in FIG. 5(B), during a period of t=1 to 2, the polarity bias value monotonously (linearly) decreases, and at point of time t=2, a polarity bias occurring during a period of t=0 to 1 is cancelled out and thus the polarity bias value W becomes "0". By this, the polarity bias is eliminated. That is, the total number of pause frame periods where a voltage is applied to the liquid crystal layer during a period of t=0 to 1 is the same as the total number of pause frame periods where a voltage is applied during a period of t=1 to 2. Note that the polarity patterns described on the right side in FIGS. 5(A) and 5(B) show that the voltage applied to the liquid crystal layer during a period of t=0 to 1 is cancelled out by the voltage applied during a period of t=1 to 2.

FIG. 5(C) shows a change in the polarity bias value W during a period of t=2 to 3, and a polarity pattern of the display unit of the liquid crystal display device. During the first refresh frame period after point of time t=2, the polarity of the voltage applied to the liquid crystal layer is reversed again by writing of a data voltage. The subsequent 59 frame periods are all pause frame periods. During the pause frame periods, a data voltage written to each pixel formation portion 10 during the immediately preceding refresh period is held at a substantially unchanged voltage value. Hence, as shown in FIG. 5(C), during a period of t=2 to 3, the polarity bias value W monotonously (linearly) increases. When an off signal Soff is provided at point of time t=3, the polarity bias value W at point of time t=3 is stored in the balance storage circuit 25 and thereafter the operation is stopped.

FIG. 5(D) shows a change in the polarity bias value W during a period from when the power is turned on again until one second has elapsed, i.e., t=0 to 1, and a polarity pattern of the display unit of the liquid crystal display device. When an on signal Son is provided to turn on the power again, in order to eliminate a polarity bias occurring during a period of t=2 to 3 shown in FIG. 5(C), insertion of a pause frame period is repeated. During the pause frame period, a data voltage having a polarity represented by the polarity bias value W is cancelled out by a data voltage having a different polarity than the polarity. Hence, decrementing the polarity bias value W by "1" every time one frame of a pause frame period is inserted is repeated. In this manner, the polarity bias value W decreases, and at point of time t=1, the polarity bias value W becomes "0" and the polarity bias is eliminated, and thus, the insertion of a pause frame period is ceased. Immediately after t=1, a refresh frame period is inserted to reverse the polarity of the voltage applied to the liquid crystal layer. Thereafter, normal pause driving is performed. Note that the polarity patterns described on the right side in FIGS. 5(C) and 5(D) show that the voltage applied to the liquid crystal layer during a period of t=2 to 3 which is before the power is turned off is cancelled out by the voltage applied during a period of t=0 to 1 which is after the power is turned on.

1.4 Second Operation Example

Figure 6:
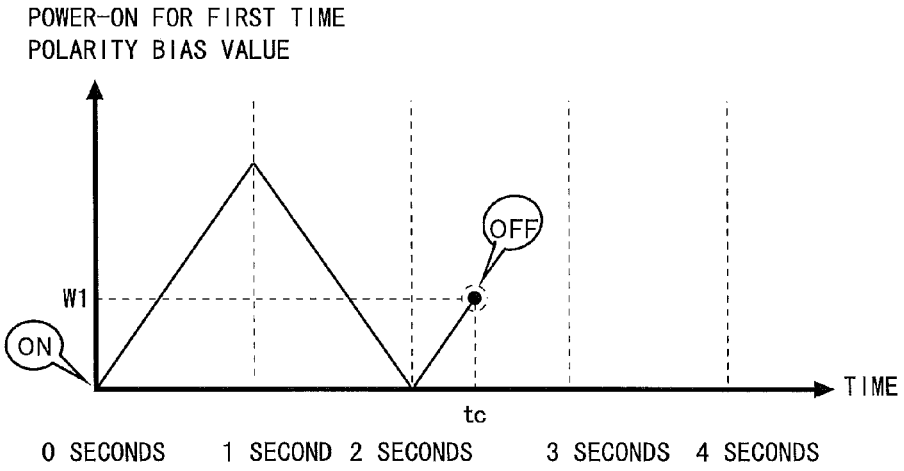
FIGS. 6(A) to 6(C) are timing charts for describing a second operation example of the liquid crystal display device according to the embodiment of the present invention.
Figure 6:
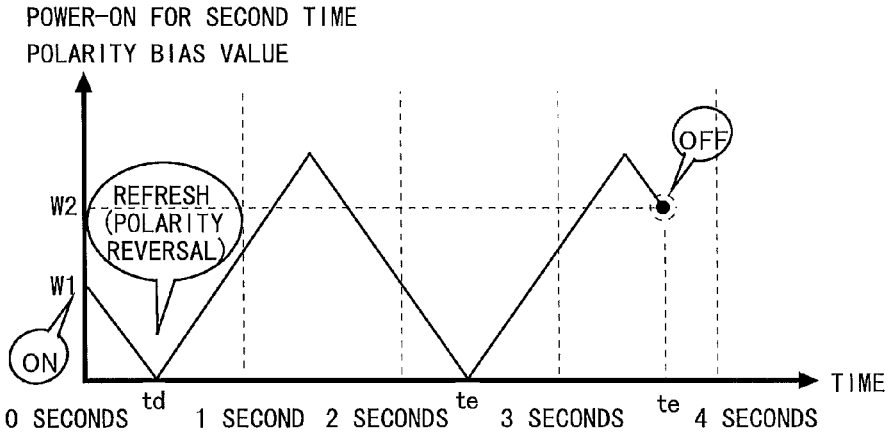
Figure 6:
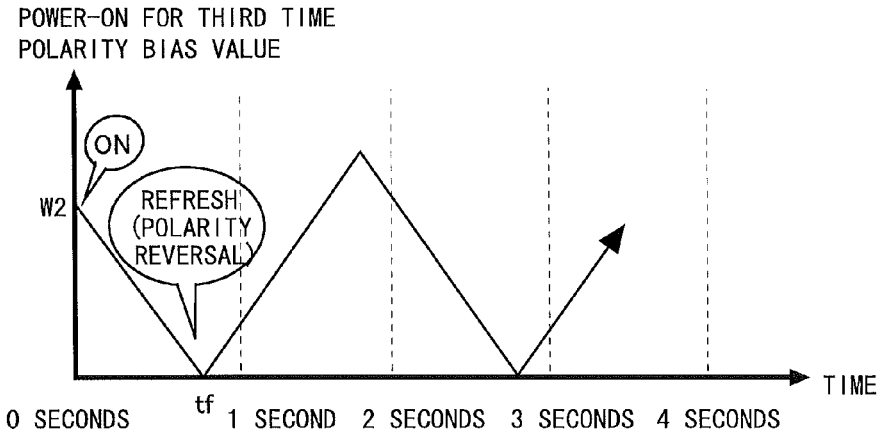

Next, a second operation example of the present embodiment will be described. FIGS. 6(A) to 6(C) are timing charts for describing the second operation example. FIG. 6A is a timing chart showing changes in the polarity bias value during a period from when the power is turned on for the first time until the power is turned off. As shown in FIG. 6(A), when the power is turned on at point of time t=0, pause driving is performed such that the first one frame period is a refresh frame period and the subsequent 59 frame periods are all pause frame periods. By this, the polarity bias value W monotonously increases. At a point of time when point of time t=2 has elapsed, the polarity is reversed and the same pause driving is performed. By this, the polarity bias value W monotonously decreases. Then, when an off signal Soff is provided at point of time t=tc between t=2 to 3, the polarity bias value W1 at point of time t=tc is stored in the balance storage circuit 25, and thereafter, the operation of the liquid crystal display device 100 is stopped.

FIG. 6(B) is a timing chart showing changes in the polarity bias value during a period from when the power is turned on for the second time until the power is turned off. As shown in FIG. 6(B), when the power is turned on for the second time, the polarity bias value W1 stored in the balance storage circuit 25 is read. Then, during a period from point of time t=0 where the power is tuned on for the second time until point of time t=td, every time one frame of a pause frame period is inserted, the polarity bias value is decremented by 1. When the polarity bias value becomes "0" in this manner at point of time t=td, the insertion of a pause frame period is ceased, and a refresh frame period is inserted to reverse the polarity of the voltage applied to the liquid crystal layer. Thereafter, normal pause driving is performed. In the pause driving, a monotonous increase and a monotonous decrease in a polarity bias are repeated while the polarity is reversed every second, by which an image based on input image data which is transmitted from the host 90 is displayed on the display unit 400.

Then, when an off signal Soff is provided from the host 90 at point of time t=te between points of time t=3 to 4, a polarity bias value W2 at point of time t=te is stored in the balance storage circuit 25, and thereafter, the operation of the liquid crystal display device 100 is stopped.

FIG. 6(C) is a timing chart showing changes in the polarity bias value during a period from when the power is turned on for the third time until the power is turned off. As shown in FIG. 6(C), when the power is turned on for the third time, the polarity bias value W2 stored in the balance storage circuit 25 is read. Then, during a period from point of time t=0 where the power is tuned on for the third time until point of time t=tf, every time one frame of a pause frame period is inserted, the polarity bias value is decremented by 1. When the polarity bias value becomes "0" in this manner at point of time t=tf, the insertion of a pause frame period is ceased, and a refresh frame period is inserted to reverse the polarity of the voltage applied to the liquid crystal layer. Thereafter, normal pause driving is performed, by which an image based on input image data which is transmitted from the host 90 is displayed on the display unit 400.

As such, when the power to the liquid crystal display device 100 is turned on again after turned off, a required number of pause frame periods are inserted to reduce the polarity bias value to "0". By this, the problems such as the occurrence of flicker can be prevented from occurring. Note that during points of time t0 to td where the power is turned on for the second time and point of times t0 to tf where the power is turned on for the third time, images that are displayed at point of time t=tc shown in FIG. 6(A) and at point of time t=te shown in FIG. 6(B) where the power is turned off are displayed again on the display unit 400. By this, after the power is turned on, a viewer can also view an image displayed at power-off immediately therebefore before viewing an image to be transmitted from the host 90.

1.5 Advantageous Effects

According to the above-described embodiment, when an off signal Soff that instructs to turn off the power is inputted, a polarity bias value W at power-off is stored in the balance storage circuit 25. Then, when the power is turned on again, the polarity bias value W is read from the balance storage circuit 25 and provided to the balance control circuit 26. The balance control circuit 26 starts insertion of a pause frame period to cancel out the polarity bias value W. By inserting a pause frame period, a voltage applied to the liquid crystal layer is cancelled out. Thus, every time a pause frame period is inserted, the polarity bias value W is decremented by "1", and at a point of time when the polarity bias value W becomes "0", the insertion of a pause frame period is ceased. At a point of time of the cessation, the polarity bias value W at a point of time of the power-off is cancelled out by the inserted pause frame periods, and thus, the time-integrated value of the voltage applied to the liquid crystal layer before starting normal pause driving becomes substantially "0". As such, the polarity bias value at a point of time when an off signal is inputted can be cancelled out in a short time after the power is turned on.

The polarity bias value W is reduced to "0" by insertion of pause frame periods in this manner, and thereafter, normal pause driving starts. Thus, at a point of time when the pause driving starts, neither accumulated charges caused by the uneven distribution of impurity ions nor accumulated charges in the pixel capacitances do not exist. Hence, by applying the present invention, the liquid crystal display device 100 that performs pause driving for the purpose of a significant power consumption reduction, etc., does not cause the problems such as the occurrence of flicker when the power is turned off and then turned on again to go into an operating state.

In addition, when an on signal Son is provided, the liquid crystal display device 100 inserts a required number of pause frame periods to eliminate a charge bias. By this, after the power is turned on, a viewer can not only view an image to be transmitted from the host 90, but can also view an image displayed on the display unit 400 at power-off immediately therebefore.

Note that in the above-described configuration the insertion of a pause frame period is ceased at a point of time when the polarity bias value W becomes "0". However, it is also possible to cease the insertion of a pause frame period at a point of time when the polarity bias value W reaches a value sufficiently close to "0" where a charge bias is reduced to a negligible level, assuming that the polarity bias value W is substantially "0". In addition, instead of the configuration in which pause frame periods are inserted until the polarity bias value W becomes "0", since it is only necessary to substantially eliminate a polarity bias of the voltage applied to the liquid crystal layer, the insertion of a pause frame period may be ceased at a point of time when the polarity bias value W reaches an appropriate value close to "0". Furthermore, since it is only necessary to reduce a polarity bias of the voltage applied to the liquid crystal layer so as to contribute to solving the problems such as the occurrence of flicker, the insertion of a pause frame period may be ceased at a point of time when the polarity bias value W reaches an appropriate value close to "0".

2. Variants

2.1 First Variant

A first variant of the above-described embodiment will be described. In the variant, the configuration of the display control unit 200 of the liquid crystal display device 100 of the above-described embodiment is partially changed.

In the above-described embodiment, the REF/NREF determination circuit 21 stores input image data for the preceding frame period in advance in the frame memory 22, and determines whether an image represented by input image data included in data DAT which is received from the host 90 is changed from an image stored in the frame memory 22.

However, the determination as to whether the image represented by the input image data included in the data DAT which is received from the host 90 is changed may be made by methods such as those shown below. To determine whether the image is changed, any one of these methods may be used or a plurality of methods which are selected as appropriate from these methods may be used in combination. In either case, the problems such as the occurrence of flicker do not occur when the power is turned on again to go into an operating state. According to the methods, even a slight change in an image can be detected.

(1) Instead of the frame memory 22, a computation result storage circuit is provided in the display control unit 200. The REF/NREF determination circuit 21 performs, for each frame, a predetermined computation process, based on input image data included in data DAT which is received from the host 90, and stores a result of the computation in the computation result storage circuit. Hence, when input image data representing an image for a certain frame is provided to the REF/NREF determination circuit 21, the REF/NREF determination circuit 21 obtains a result of computation for the frame and compares the result of computation with a result of computation for the preceding frame to determine whether the image is changed. Specifically, if the results of computation for the two frames are the same, the REF/NREF determination circuit 21 determines that the images are the same. If different, the REF/NREF determination circuit 21 determines that the images are different. Such a predetermined computation process includes calculation of the sum total of pixel values for one frame, calculation of a checksum, etc. According to this method, without the device including a large-capacity memory, whether an image is changed can be detected.

(2) For each frame period, a dedicated signal indicating whether the frame period is a refresh frame period or a pause frame period is received from the host 90.

(3) For each frame period, the host 90 writes data indicating whether the frame period is a refresh frame period or a pause frame period, in a specific register provided in the display control unit 200.

(4) When data DAT received from the host 90 includes input image data, it is determined that the next frame period is a refresh frame period. When not including input image data, it is determined that the next frame period is a pause frame period.

(5) For each frame period, it is determined whether the frame period is a refresh frame period or a pause frame period so that refresh can be performed periodically when data DAT received from the host 90 does not include input image data.

2.2 Second Variant

Figure 7:
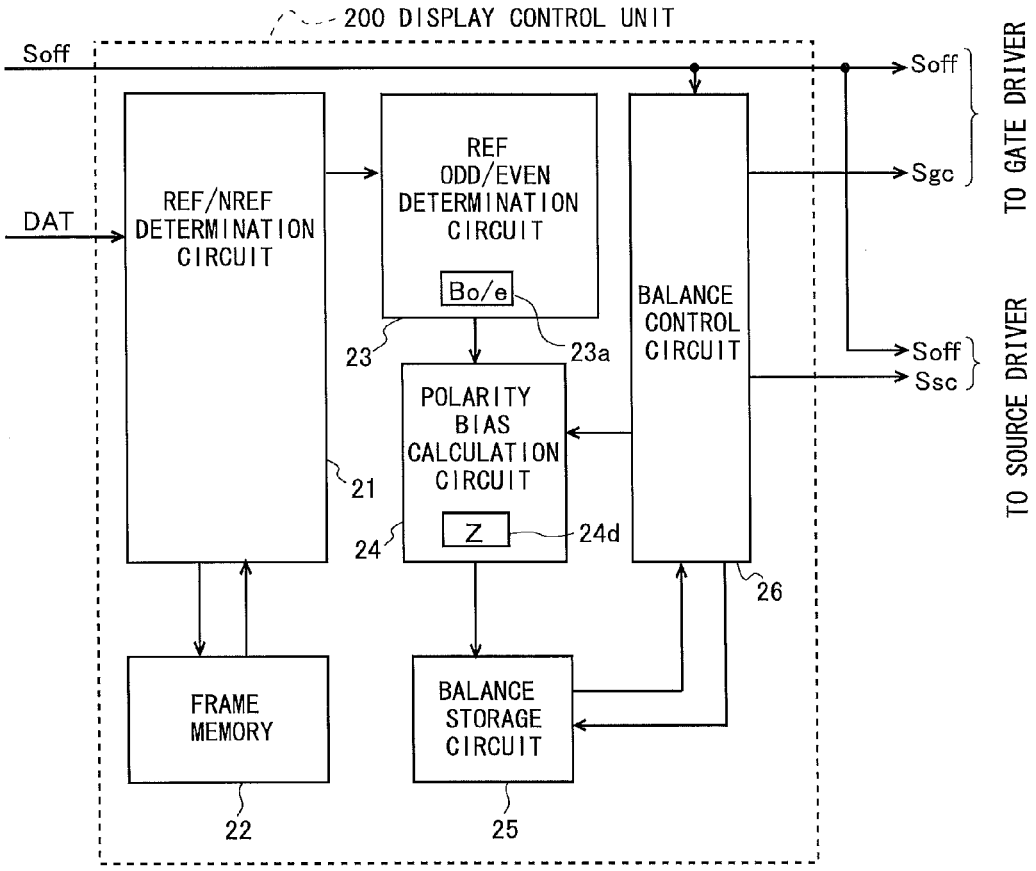
FIG. 7 is a block diagram showing a configuration of a display control unit of a liquid crystal display device according to a third variant of the embodiment of the present invention.

A second variant of the above-described embodiment will be described. FIG. 7 is a block diagram showing a configuration of a display control unit 200 of a liquid crystal display device according to the present variant. In the variant, as shown in FIG. 7, the configuration of the polarity bias calculation circuit 24 of the display control unit 200 shown in FIG. 4 is partially changed. A detailed description of the same configurations as those shown in FIG. 4 is omitted.

In the above-described embodiment, as shown in FIG. 4, the first polarity counter 24*a* and the second polarity counter 24*b* are provided in the polarity bias calculation circuit 24. A polarity bias value W which is a difference between a first count value Na counted by the first polarity counter 24*a* and a second count value Nb counted by the second polarity counter 24*b* is determined. Then, a bias of a voltage applied to the liquid crystal layer is determined by the polarity bias value W. However, only one polarity bias counter 24*d* may be provided in the polarity bias calculation circuit 24. A polarity bias value that is counted by the polarity bias counter 24*d*, is represented by the symbol "Z".

The polarity bias calculation circuit 24 sets the polarity bias value Z of the polarity bias counter 24*d* to "0" first. When the power is turned on, the polarity bias calculation circuit 24 repeats incrementing the polarity bias value Z by "1" every time one pause frame period ends during a period from when the first refresh frame period ends until the next refresh frame period starts. By this, the polarity bias value Z is counted up by 1 every pause frame period.

When the next refresh frame period is inserted, the polarity bias calculation circuit 24 repeats decrementing the polarity bias value Z by "1" every time one pause frame period ends during a period from when the refresh frame period ends until the next refresh frame period starts. By this, the polarity bias value Z is counted down by 1 every pause frame period.

Whether the polarity bias value Z is counted up or down is determined by an odd/even signal provided from the REF odd/even determination circuit 23. The polarity bias calculation circuit 24 switches between count-up and count-down, based on the odd/even signal. Specifically, when the power is turned on, the polarity bias value Z of the polarity bias counter 24*d* is reset to "0". Thereafter, since the odd/even signal is "1" during a period from the first refresh period until the second refresh period, the polarity bias calculation circuit 24 increments the polarity bias value Z of the polarity bias counter 24*d* by "1" every time a REF/NREF signal indicating a pause frame period included in the refresh period is provided. Then, since the odd/even signal is "0" during a period from the second refresh period until the third refresh period, the polarity bias value Z of the polarity bias counter 24*d* is decremented by "1" every time a REF/NREF signal indicating a pause frame period that follows the immediately preceding refresh frame period is provided. Thereafter, likewise, incrementing and decrementing the polarity bias value Z of the polarity bias counter 24*d* by "1" are repeated. By this, the polarity bias value Z indicating a polarity bias is held in the polarity bias counter 24*d*. In this manner, the polarity bias value Z can be easily and promptly determined when an off signal is inputted.

When an off signal Soff is provided from the host 90, the polarity bias calculation circuit 24 stores the polarity bias value Z in the balance storage circuit 25 based on a stop signal provided from the balance control circuit 26, and resets the polarity bias value Z to "0". Thereafter, the power to the liquid crystal display device 100 is turned off.

When the power is turned on again, the balance control circuit 26 reads the polarity bias value Z stored in the balance storage circuit 25, and repeats decrementing the polarity bias value Z by 1 by inserting one frame of a pause frame period at a time. By reducing the polarity bias value Z to "0" in this manner, the polarity bias is eliminated. Then, the insertion of a pause frame period is ceased and a refresh frame period is inserted. By this, the polarity of the voltage applied to the liquid crystal layer is reversed, and thereafter, normal pause driving starts. Therefore, the problems such as the occurrence of flicker do not occur when the power is turned on again to go into an operating state.

2.3 Third Variant

Figure 8:
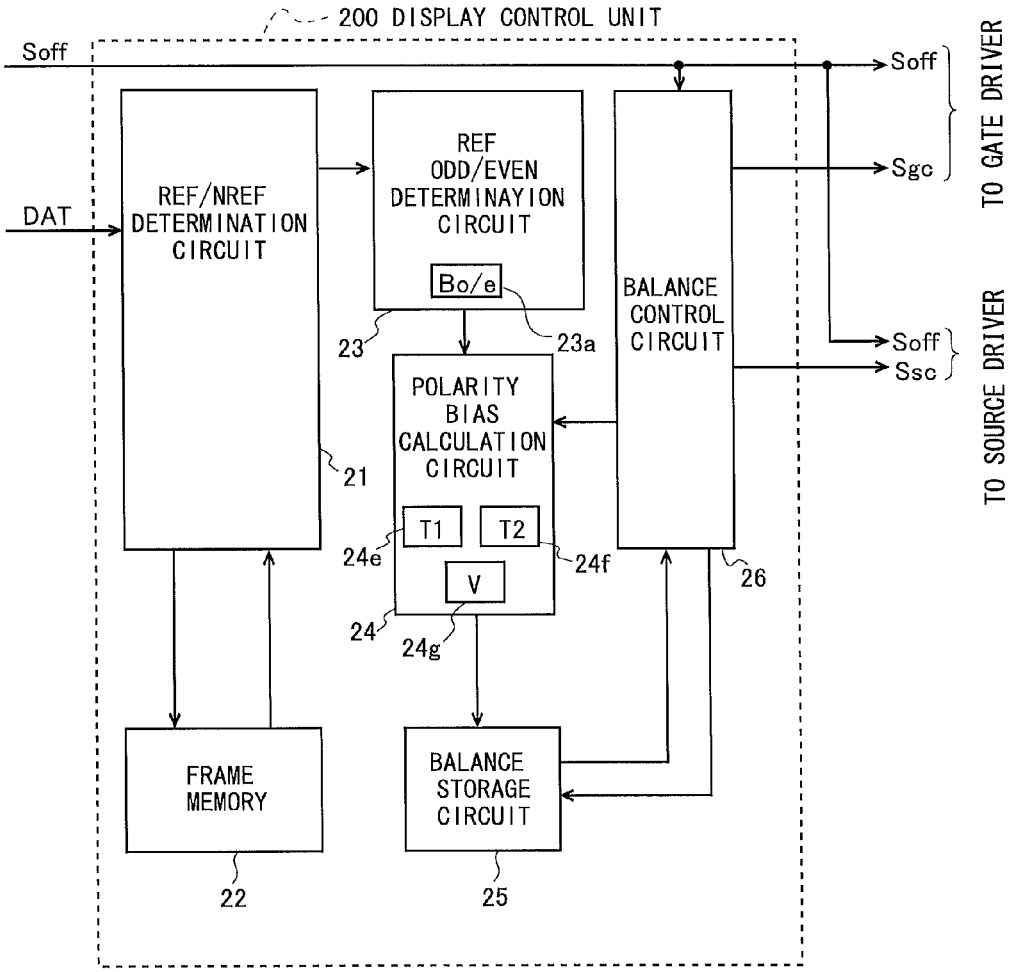
FIG. 8 is a block diagram showing a configuration of a display control unit of a liquid crystal display device according to a fourth variant of the embodiment of the present invention.

A third variant of the above-described embodiment will be described. FIG. 8 is a block diagram showing a configuration of a display control unit 200 of a liquid crystal display device according to the variant. In the variant, as shown in FIG. 8, the configuration of the polarity bias calculation circuit 24 of the display control unit 200 shown in FIG. 4 is partially changed. A detailed description of the same configurations as those shown in FIG. 4 is omitted.

In the above-described embodiment, as shown in FIG. 4, the first polarity counter 24*a* provided in the polarity bias calculation circuit 24 counts the number of pause frame periods appearing immediately after an odd-numbered refresh period, and the second polarity counter 24*b* counts the number of pause frame periods appearing immediately after an even-numbered refresh period.

However, as shown in the variant, the unit that indicates the degree of polarity bias may be changed to other ones. For example, the first and second polarity counters 24*a* and 24*b* may be replaced by first and second timers 24*e* and 24*f*, respectively. In this case, the first timer 24*e* determines a total amount of time T1 of pause frame periods that follow an odd-numbered refresh period after the power is turned on, and the second timer 24*f* measures a total amount of time T2 of pause frame periods that follow an even-numbered refresh period after the power is turned on. Based on the total amounts of time T1 and T2, the difference therebetween is used as polarity bias time V and the polarity bias time V is held in a polarity bias counter 24*g*. By this, the polarity bias time V can be easily and promptly determined when an off signal is inputted.

When the power is turned off, the polarity bias time V held in the polarity bias counter 24*g* is stored in the balance storage circuit 25. When the power is turned on again, the balance control circuit 26 reads the polarity bias time V stored in the balance storage circuit 25, and inserts pause frame periods such that the polarity bias time V becomes "0". Every time a pause frame period is inserted, the pause frame period is subtracted from the polarity bias time V. At a point of time when the polarity bias time V becomes "0" in this manner, the insertion of a pause frame period is ceased and a refresh frame period is inserted. By this, the polarity of the voltage applied to the liquid crystal layer is reversed, and thereafter, normal pause driving starts. Therefore, the problems such as the occurrence of flicker do not occur when the power is turned on again to go into an operating state.

2.4 Fourth Variant

A fourth variant of the above-described embodiment will be described. In the above-described embodiment, only periodic refresh is performed. However, in the variant, not only periodic refresh, but also forced refresh is further performed. Note that those frame periods other than refresh frame periods for periodic refresh or forced refresh are pause frame periods.

Figure 9:
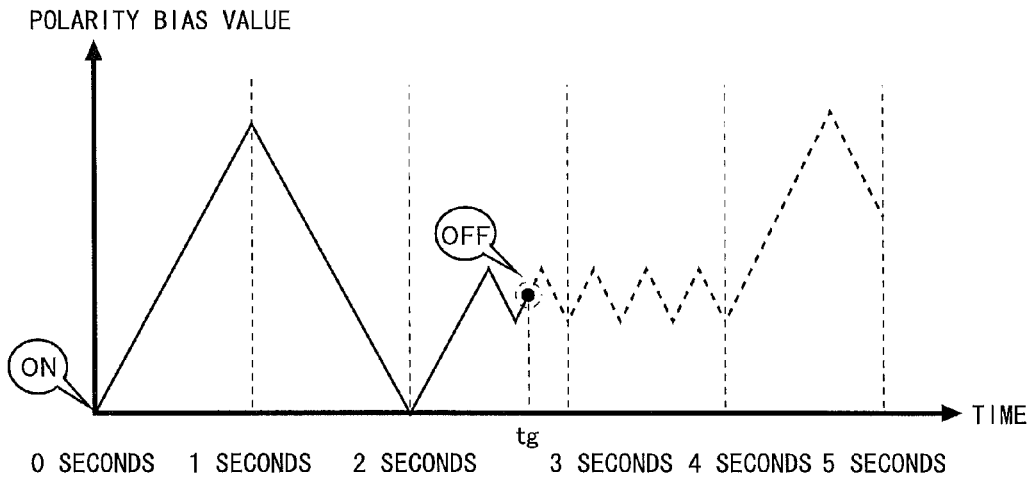
FIGS. 9(A) and 9(B) are timing charts showing an operation example of a fifth variant of the embodiment of the present invention.
Figure 9:
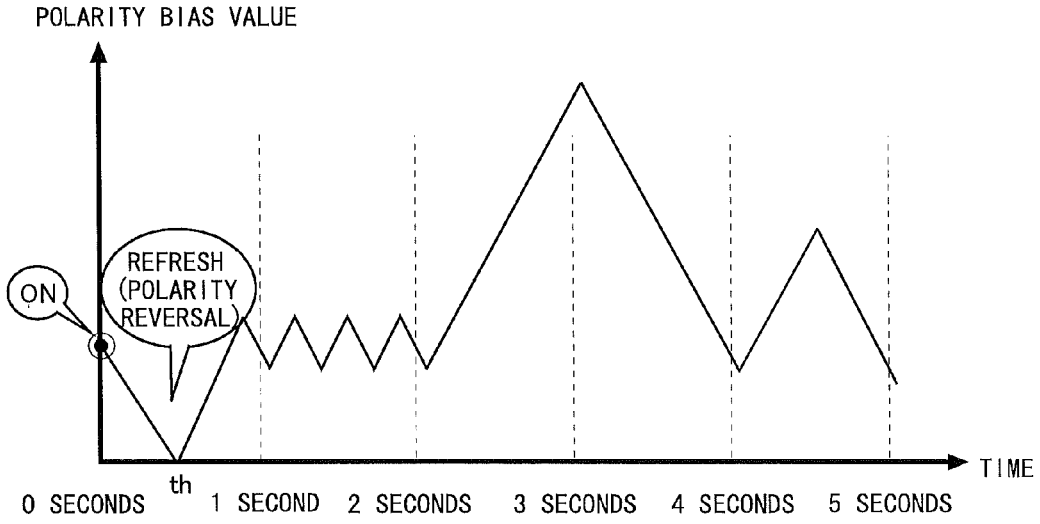

FIGS. 9(A) and 9(B) are timing charts showing an operation example of the liquid crystal display device of the variant. As shown in FIG. 9, the first refresh (writing of a data voltage to each pixel formation portion 10) is performed immediately after the power is turned on, and furthermore, periodic refresh is performed at point of time t=1 and point of time t=2. Thereafter, two forced refreshes are performed during a period of t=2 to 3. Furthermore, at point of time tg, an off signal Soff instructing to turn off the power is inputted to the balance control circuit 26 from the host 90. When the off signal Soff is provided, the balance control circuit 26 generates and provides a stop signal to the polarity bias calculation circuit 24, and the polarity bias calculation circuit 24 stores a polarity bias value W obtained at point of time tg in the balance storage circuit 25.

Thereafter, when an on signal Son is inputted to the balance control circuit 26, the balance control circuit 26 reads the polarity bias value W from the balance storage circuit 25, and repeats decrementing the polarity bias value W by "1" every time a pause frame period is inserted. Then, at point of time when the polarity bias value W becomes "0", the balance control circuit 26 ceases the insertion of a pause frame period and inserts a refresh frame period. By this, the polarity of the voltage applied to the liquid crystal layer is reversed. Thereafter, normal pause driving starts. As such, the present invention can also be applied to the case of a liquid crystal display device that performs not only periodic refresh, but also forced refresh, and thus, the problems such as the occurrence of flicker do not occur when the power to such a liquid crystal display device is turned on again and thereby goes into an operating state.

2.5 Fifth Variant

A fifth variant of the above-described embodiment will be described. In the above-described embodiment, an oxide TFT (more specifically, a TFT using In—Ga—Zn—O as a channel layer) is used as a switching element in each pixel formation portion 10, and thus, off-leakage current is very small. However, as the switching element, for example, a silicon-based TFT such as amorphous silicon or polycrystalline silicon can also be used. In this case, since the off-leakage current of a silicon-based TFT is large, when there is a long time before the power is turned on again after the power is turned off, charges accumulated in the pixel capacitances are discharged. Hence, it is also possible to omit the operation for inserting a pause frame period which is required to reduce the polarity bias value W to "0" when the power is turned on again.

2.6 Sixth Variant

A sixth variant of the above-described embodiment will be described. In the above-described embodiment, the balance storage circuit 25 is formed of a nonvolatile memory such as a flash memory. However, the balance storage circuit 25 may be formed of a volatile memory such as a DRAM (Dynamic Random Memory). By this, as long as the design is such that in a system such as an electronic device that has the liquid crystal display device mounted thereon, even if the power to the liquid crystal display device is turned off, power is supplied to the DRAM forming the balance storage circuit 25, the balance storage circuit 25 can continuously store the polarity bias value W.

2.7 Other Variants

It is premised that the liquid crystal display devices 100 according to the above-described embodiment and the variants thereof perform pause driving. However, the present invention is not limited thereto, and can also be applied to a liquid crystal display device that performs normal driving where pause periods do not appear. Even if a liquid crystal display device is of a normal driving scheme, when data voltages are written to the pixel formation portions over a plurality of frame periods without reversing polarities, the present invention is particularly effective. In addition, although the display control unit 200 is all implemented by hardware, a part or all of the configuration of the display control unit 200 may be implemented in a software manner.

INDUSTRIAL APPLICABILITY

The present invention is used for liquid crystal display devices that use TFTs having a channel layer made of an oxide semiconductor, as switching elements in pixel formation portions. Among the liquid crystal display devices, the present invention is used particularly for a liquid crystal display device that performs pause driving.

DESCRIPTION OF REFERENCE CHARACTERS

10: PIXEL FORMATION PORTION
11: THIN FILM TRANSISTOR (TFT)
12: PIXEL ELECTRODE
13: COMMON ELECTRODE
21: REF/NREF DETERMINATION CIRCUIT
22: FRAME MEMORY
23: REF ODD/EVEN DETERMINATION CIRCUIT
23*a*: ODD/EVEN BIT REGISTER
24: POLARITY BIAS CALCULATION CIRCUIT
24*a*: FIRST POLARITY COUNTER
24*b*: SECOND POLARITY COUNTER
24*c*: POLARITY BIAS COUNTER
24*d*: POLARITY BIAS COUNTER
24*e*: FIRST TIMER
24*f*: SECOND TIMER
24*g*: POLARITY BIAS COUNTER
25: BALANCE STORAGE CIRCUIT
26: BALANCE CONTROL CIRCUIT
100: LIQUID CRYSTAL DISPLAY DEVICE
200: DISPLAY CONTROL UNIT
300: DRIVING UNIT
310: SOURCE DRIVER
320: GATE DRIVER
400: DISPLAY UNIT
Cp: PIXEL CAPACITANCE
Son: ON SIGNAL
Soff: OFF SIGNAL
W: POLARITY BIAS VALUE
Z: POLARITY BIAS VALUE
V: POLARITY BIAS TIME

The invention claimed is:

1. A liquid crystal display device that displays an image represented by input image data on a display by applying voltages according to the input image data to a liquid crystal layer, the device comprising:

driving circuitry that applies the voltages according to the input image data to the liquid crystal layer; and display control circuitry that stores a polarity bias value when an off signal instructing to turn off power to the liquid crystal display device is inputted, and drive, when an on signal instructing to turn on the power is inputted thereafter, the driving circuitry such that the polarity bias value is cancelled out before the image is displayed on the display, the polarity bias value indicating a degree of polarity bias of the voltages applied to the liquid crystal layer up to a point of time when the off signal is inputted, wherein the display includes a plurality of pixel formation portions that hold voltages to be applied to the liquid crystal layer as data voltages, and the display control circuitry includes:

balance storage circuitry that stores the polarity bias value;

polarity bias calculating circuitry that calculates the polarity bias value and store the polarity bias value in the balance storage circuitry when the off signal is inputted; and balance control circuitry that reads the polarity bias value stored in the balance storage circuitry when the on signal is inputted, and control the driving circuitry such that the polarity bias value is cancelled out, the polarity bias calculating circuitry includes a first polarity counter and a second polarity counter that count a number of pause periods during which writing of the data voltages is paused, and adds a number of pause frame periods with a first polarity provided after the input of the on signal to a number of pause frame periods held in the first polarity counter, adds a number of pause frame periods with a second polarity different than the first polarity to a number of pause frame periods held in the second polarity counter, and calculates, when the off signal is inputted, a difference between the number of pause frame periods with the first polarity held in the first polarity counter and the number of pause frame periods with the second polarity held in the second polarity counter, to use the difference as the polarity bias value.

2. A liquid crystal display device that displays an image represented by input image data on a display by applying voltages according to the input image data to a liquid crystal layer, the device comprising:

a driving circuitry that applies the voltages according to the input image data to the liquid crystal layer; and a display control circuitry that stores a polarity bias value when an off signal instructing to turn off power to the liquid crystal display device is inputted, and drive, when an on signal instructing to turn on the power is inputted thereafter, the driving circuitry such that the polarity bias value is cancelled out before the image is displayed on the display, the polarity bias value indicating a degree of polarity bias of the voltages applied to the liquid crystal layer up to a point of time when the off signal is inputted, wherein the display includes a plurality of pixel formation portions that hold voltages to be applied to the liquid crystal layer as data voltages, and the display control circuitry includes:

balance storage circuitry that stores the polarity bias value;

polarity bias calculating circuitry that calculates the polarity bias value and store the polarity bias value in the balance storage circuitry when the off signal is inputted; and balance control circuitry that reads the polarity bias value stored in the balance storage circuitry when the on signal is inputted, and control the driving circuitry such that the polarity bias value is cancelled out, the polarity bias calculating circuitry includes a polarity bias counter that counts a number of pause periods during which writing of the data voltages is paused, and adds, when a polarity of a pause frame period provided after the input of the on signal is a first polarity, a number of frame periods with the first polarity to a number of pause periods held in the polarity bias counter, subtracts, when the polarity of the pause frame period is a second polarity different than the first polarity, a number of frame periods with the second polarity from the number of pause periods held in the polarity bias counter, and uses the number of pause frame periods held in the polarity bias counter as the polarity bias value when the off signal is inputted.

3. A liquid crystal display device that displays an image represented by input image data on a display by applying voltages according to the input image data to a liquid crystal layer, the device comprising:

driving circuitry that applies the voltages according to the input image data to the liquid crystal layer; and display control circuitry that stores a polarity bias value when an off signal instructing to turn off power to the liquid crystal display device is inputted, and drive, when an on signal instructing to turn on the power is inputted thereafter, the driving circuitry such that the polarity bias value is cancelled out before the image is displayed on the display, the polarity bias value indicating a degree of polarity bias of the voltages applied to the liquid crystal layer up to a point of time when the off signal is inputted, wherein the display includes a plurality of pixel formation portions that hold voltages to be applied to the liquid crystal layer as data voltages, and the display control circuitry includes:

balance storage circuitry that stores the polarity bias value;

polarity bias calculating circuitry that calculates the polarity bias value and stores the polarity bias value in the balance storage circuitry when the off signal is inputted;

balance control circuitry that reads the polarity bias value stored in the balance storage circuitry when the on signal is inputted, and controls the driving circuitry such that the polarity bias value is cancelled out; and REF/NREF determining circuitry that determines, for each frame period, whether the frame period is a refresh period during which data voltages are written to the plurality of pixel formation portions or a pause period during which writing of the data voltages to the plurality of pixel formation portions is paused, the balance control circuitry controls the driving circuitry when the on signal is inputted again after an off signal is inputted, such that a pause period with a polarity different than that of the polarity bias value obtained at a point of time when the off signal is inputted is inserted, the display control circuitry further includes a REF odd/even determination circuit that generates an odd/even signal indicating a result of a determination as to whether a total number of refresh frames determined by the REF/NREF determining circuitry is an odd number or an even number, and output the odd/even signal to the polarity bias calculation circuit calculating portion, and the polarity bias calculation circuit calculating portion includes a first polarity counter and a second polarity counter that count a number of pause periods during which writing of the data voltages is paused, and add a number of pause periods following an odd-numbered refresh frame to a number of pause periods held in the first polarity counter when it is determined based on the odd/even signal that the total number of refresh frames determined is an odd number, and add, when the number of refresh frames is an even number, a number of pause periods following an even-numbered refresh frame to a number of pause periods held in the second polarity counter, and calculate, when the off signal is inputted, a difference between the number of pause periods held in the first polarity counter and the number of pause periods held in the second polarity counter, to use the difference as the polarity bias value.

4. A liquid crystal display device that displays an image represented by input image data on a display by applying voltages according to the input image data to a liquid crystal layer, the device comprising:

driving circuitry that applies the voltages according to the input image data to the liquid crystal layer; and display control circuitry that stores a polarity bias value when an off signal instructing to turn off power to the liquid crystal display device is inputted, and drive, when an on signal instructing to turn on the power is inputted thereafter, the driving circuitry such that the polarity bias value is cancelled out before the image is displayed on the display, the polarity bias value indicating a degree of polarity bias of the voltages applied to the liquid crystal layer up to a point of time when the off signal is inputted, wherein the display includes a plurality of pixel formation portions that hold voltages to be applied to the liquid crystal layer as data voltages, and the display control circuitry includes:

balance storage circuitry that stores the polarity bias value;

polarity bias calculating circuitry that calculates the polarity bias value and stores the polarity bias value in the balance storage circuitry when the off signal is inputted;

balance control circuitry that reads the polarity bias value stored in the balance storage circuitry when the on signal is inputted, and controls the driving circuitry such that the polarity bias value is cancelled out; and REF/NREF determining circuitry that determines, for each frame period, whether the frame period is a refresh period during which data voltages are written to the plurality of pixel formation portions or a pause period during which writing of the data voltages to the plurality of pixel formation portions is paused, the balance control circuitry controls the driving circuitry when the on signal is inputted again after an off signal is inputted, such that a pause period with a polarity different than that of the polarity bias value obtained at a point of time when the off signal is inputted is inserted, the display control circuitry further includes a REF odd/even determination circuit that generates an odd/even signal indicating a result of a determination as to whether a total number of refresh frames determined by the REF/NREF determining circuitry is an odd number or an even number, and outputs the odd/even signal to the polarity bias calculation circuit calculating portion, and the polarity bias calculation circuit calculating portion includes a polarity bias counter that counts a number of pause periods during which writing of the data voltages is paused, and adds a number of pause periods following an odd-numbered refresh frame to a number of pause periods held in the polarity bias counter when it is determined based on the odd/even signal that the total number of refresh frames determined is an odd number, and subtract, when the number of refresh frames is an even number, a number of pause periods following an even-numbered refresh frame from the number of pause periods held in the polarity bias counter, and calculate, when the off signal is inputted, a number of pause periods held in the polarity bias counter to use the number of pause periods as the polarity bias value.

* * * * *